United States Patent [19]

Shoji et al.

[11] Patent Number: 4,669,864

[45] Date of Patent: Jun. 2, 1987

[54] IMAGE FORMING APPARATUS

[75] Inventors: Hisashi Shoji; Satoshi Haneda; Seiichiro Hiratsuka; Hiroshi Fuma; Shinobu Soma, all of Hachioji; Masahiko Itaya, Tachikawa; Akihiko Tamura; Kazushi Hayakawa, both of Hachioji, all of Japan

[73] Assignee: Konishiroku Photo Industry Co., Ltd., Tokyo, Japan

[21] Appl. No.: 823,174

[22] Filed: Jan. 27, 1986

[30] Foreign Application Priority Data

| | | | |
|---|---|---|---|
| Jan. 31, 1985 | [JP] | Japan | 60-18371 |
| Feb. 8, 1985 | [JP] | Japan | 60-23112 |
| Feb. 20, 1985 | [JP] | Japan | 60-33565 |
| Dec. 24, 1985 | [JP] | Japan | 60-296339 |

[51] Int. Cl.[4] ..... G03G 15/00; G03G 15/01

[52] U.S. Cl. ..... 355/15; 355/3 R; 355/4

[58] Field of Search ..... 355/15, 3 R, 3 DD, 4, 355/14 D, 14 R

[56] References Cited

U.S. PATENT DOCUMENTS

| | | | |
|---|---|---|---|
| 4,181,425 | 1/1980 | Higaya et al. | 355/15 |
| 4,263,390 | 4/1981 | Yamashita et al. | 355/15 X |
| 4,439,035 | 3/1984 | Landa | 355/15 |
| 4,515,467 | 5/1985 | Suzuki | 355/15 |

*Primary Examiner*—A. C. Prescott

*Attorney, Agent, or Firm*—Jordan B. Bierman

[57] ABSTRACT

An image forming apparatus having a cleaning device arranged on the outer periphery of an image retainer, and bringing into and out of abutment against the image retainer, wherein the cleaning device comprises a first cleaning member and a second cleaning member arranged downstream of the first cleaning member in the moving direction of the surface of the image retainer. A cleaning operation of the second cleaning member against the image retainer is conducted according to a time at which the cleaning operation of the first cleaning member against the image retainer is conducted.

21 Claims, 31 Drawing Figures

IMAGE FORMING APPARATUS

BACKGROUND OF THE INVENTION

1. Field of the Invention

The present invention relates to an image forming apparatus and, more specifically, to a multi-color image forming apparatus for forming a multi-color image by forming toner images in different colors sequentially on an image retainer so that it can be used in the field of electrophotography.

2. Description of the Prior Art

In the prior art, in order to form a multi-color image by the electrophotography, for example, a series of steps of charge, exposure (image writing), development and transfer are repeated for each color component to transfer toner images in individual colors onto a recording paper in a superposed manner. For example, electrostatic latent images are formed separately at the respective steps by separated colors which are obtained through color separation filters of such as blue, green and red and are developed in Yellow, Magenta and cyan or, if necessary, black toner to form monochromatic toner images. These toner images are transferred in the formed order to the recording paper to form the multi-color image. In this multi-color forming method, however, there arise difficulties:

(1) a transfer to recording paper becomes necessary at the end of development of each color to enlarge the size of the apparatus and to elongate the time period for the image formation; and (2) failure of registration due to the repeated operations becomes liable to occur.

Therefore, there has been proposed a multi-color image forming method for eliminating those difficulties by separating the colors of optical information of an original into time-series signals by means of a CCD solid-state image sensor through color filters, by developing a plurality of toner images on a common photosensitive member in a superposed manner to reduce the transfer steps to one. However, this method is also encountered by a trouble that a toner image developed at a previous step is disturbed at a subsequent developing step or that toner in a developer at a preceding step is mixed with a developer at a succeeding step to break the color balance of the multi-color image.

In order to avoid this trouble, there has also been developed a method for forming a multi-color image by adopting a method in which a bias having a superposed a.c. component is applied to a developing device at a second or later developments to fly toner onto an electrostatic latent image formed on an image retainer. According to this method, the developer layer will not rub the toner image or images formed at the preceding step so that no image disturbance will occur.

The principle of this multi-color image forming method will be described in the following with reference to a flow chart of FIG. 15. FIG. 15 shows changes in the surface potential of the photosensitive member and takes up a case in which the charge polarity is positive. Reference letters PH indicate an exposed portion of the photosensitive member; letters DA, an unexposed portion of the photosensitive member; and letters DUP, the rise of potential, which is caused as a result that positively charged toner T sticks to the exposed portion PH in a first development.

The photosensitive member is charged evenly by a scorotron charger to have a constant positive surface potential E, as shown in (a). Next, a first image exposure is effected by means of an exposing source such as a laser, a cathode ray tube or an LED so that the potential of the exposed portion PH drops, as shown in (b), in accordance with the quantity of light. An electrostatic latent image thus formed is developed by means of a developing device to which is applied a positive bias substantially equal to the surface potential E of the unexposed portion. As a result, as shown in (c), the positively charged toner T sticks to the exposure portion having a lower potential to form the first toner image T. The region formed with that toner image has the potential rise DUP as a result of the stick of the positively charged toner T, but will not have the same potential as that of the unexposed portion DA. Next, the photosensitive member surface formed with the first toner image is subjected to a second charge by a charger so that it takes the uniform surface potential E despite whether the toner T is present or absent. This is shown in (d). The surface of that photosensitive member is subjected to a second image exposure to form an electrostatic latent image (as shown in (e)), and a positively charged toner image T' in a color different from that of the toner T is developed like the step (c) to form a second toner image. This is shown in (f). The process thus far described is repeated to form a multi-color toner image on the photosensitive member. It is transferred onto the recording paper and is further heated and processed for fixing to obtain a multi-color recorded image. In this case, the photosensitive member is cleaned through cleaning of the toner and charges having remained on its surface and is used for forming a next multi-color image. On the other hand, there is another method by which a toner image is fixed on a photosensitive member in a different manner.

In the method described with reference to FIG. 15, it is desirable that at least the developing step of (f) be conducted such that the developer layer is out of contact with the photosensitive member surface.

Incidentally, in the aforementioned multi-color image forming method, the second and later charges can be omitted. In case where charging is repeated each time of the image formation, a charge eliminating step may be incorporated before the charging step. On the other hand, the exposure source for the image exposure may be either identical or different at each time.

In the electrophotography, a gas or semiconductor laser beam, an LED, a CRT or a liquid crystal is used as the image exposing means.

As the latent image forming method for forming the multi-color image, there can be used in addition to the aforementioned electrophotographic method a method, in which charges are implanted directly into an image forming member by means of a multi-stylus electrode to form an electrostatic latent image, or a method in which a magnetic latent image is formed by means of a megnetic head.

In the non-contact developing described above, it is preferable to apply an a.c. bias to the developing device so as to supply the latent image with sufficient toner. Moreover, it is desirable that the a.c. bias be applied exclusively to the developing device containing the toner in a color to be developed. If the a.c. bias is applied to the developing device having no contribution to the development, the toner in that developing device will stick to the latent image surface to make the color turbid, or the toner in a different color having stuck to the image retainer will mix with the developing device to adversely affect the color reproduction.

This makes it necessary to turn on and off the a.c. bias each time of development for each developing device. At this piont time, however, switching noises may be generated to malfunction the latent image forming means to invite missings of dots or breakage of the image data.

In this multi-color image forming apparatus, on the other hand, it is desired to provide drive means for turning developing sleeves or inside magnetic rolls separately for the individual developing devices. This is explained by the following reasons in case a common drive source is to be used:

(1) Each developing device has to be equipped with drive force transmitting means such as belt or chain; and (2) Means for connecting and disconnecting the drive force individually (such as clutch) is required. To meet these requirements, the apparatus becomes complicated, and the drive source is required to endure a high torque. In case the drive sources are provided individually, on the contrary, the drive force transmission means can be dispensed with, and each drive source may be small enough for actuating one developing device. In this case, too, it is desired that each developing device be driven only for a time period of contributing to the development. If the developing device out of the development is driven, its toner will stick to the latent image surface to make the color turbid, or the toner already having stuck to the image retainer will mix.

Therefore, the drive source for each driving device has to be turned on and off for each development. In this case, however, there is a fear that the switching noises will be generated to result in malfunctions of the latent image forming means, as has been described hereinbefore. Causes of the switching noises are not clearly found out but seem to come from the electromagnetic waves, the changes in the earth potential or the stray capacity, which are generated when the drive sources are turned on and off.

In addition, the sources for malfunctions of the latent image forming means are located in portions for applying high voltage such as charge electrodes or transfer electrodes, for example, in the case of the electrophotography.

The malfunctions of the latent image forming means due to the aforementioned switching noises are especially liable to occur in the so-called "digital type image formations" in which the image is formed by reading and storing an original image in an image memory and on the basis of the storage of the image memory.

In another multi-color image forming apparatus of the prior art, moreover, the toner images of individual colors formed on the image retainer are transferred sequentially to the recording paper, on which the toner images are superposed. However, this multi-color image forming apparatus is encountered by problems that the necessity for a transfer drum enlarges the size of the apparatus and that the transfer misregistrations of the toner images in the individual colors are caused to make it impossible to form a clear multi-color image.

In the image forming apparatus for forming a plurality of toner images in the superposed manner on the image retainer, however, it is necessary to release the abutment of a blade against the image retainer in the toner image superposing procedures so as to prevent the preceding toner image from being damaged. Here, the cleaning of the residual toner by means of the blade is usually conducted by bringing an elastic plate member into abutment against the surface of the image retainer to scrape off the toner in accordance with the turns of the image retainer. As a result, if the blade abutting against the image retainer is abruptly separated when it is to be released from its abutting state, the toner being scraped is left as it is on the image retainer and is carried out of the cleaning device to raise a problem that it blots the peripheral devices of the image retainer or obstructs formation of a next image.

When the cleaning blade is continuously held in sliding contact with the surface of the image retainer, more specifically, there arises a defect that the retainer surface is damaged while the blade has its edge portion worn so that the cleaning operation cannot be conducted for a long time period. In order to eliminate this defect, there has been proposed a cleaning device in which a blade member is made so movable that it comes into sliding contact with the image retainer only when the image retainer bearing the residual toner left after the transfer comes to the cleaning portion, whereas it is retracted from the image retainer surface for the other time period. This technical means has an effect that it does not damage the image retainer surface but to elongate the lifetime of the blade. In the cleaning device having the blade member to be brought into and out of abutment against the image retainer, however, the scraped toner stored on the edge portion of the blade member when this member is removed from the image retainer is left on the image retainer to raise another problem that it overlaps a next new image to disturb it.

SUMMARY OF THE INVENTION

The present invention has been conceived in view of the background thus far described and has an object to provide an image forming apparatus for forming an always stable, high-quality image without any fear that the latent image forming means malfunctions to disturb the latent image thereby not to form the recorded image in high quality as a result of generation of the switching noises, for example, due to the abrupt changes in conditions of the apparatus.

According to the present invention, more specifically, there is provided an image forming device, in which the steps of forming a latent image by writing an image on an image retainer and of developing the latent image are repeated several times, which device is characterized in that the electrical conditions of the apparatus is not abruptly changed during the aforementioned image writing operation.

Incidentally, according to a preferred mode of the present invention, the image forming apparatus is constructed such that the development is effected by a developing device, to which a bias power is applied, in a manner not to abruptly change the bias voltage while an image is being written, and/or such that the development is conducted by the developing device belonging for each developer carrying means to drive means for driving the developer carrying means in a manner not to abruptly change the carrying velocity of the aforementioned developer carrying means during the image writing operation.

The electric status of the aforementioned apparatus implies the bias to be applied to the aforementioned device, the developer carrying velocity of the developing device, and the levels of electric quantities such as the voltage or current of a portion (e.g., a charger) to which a high voltage is to be applied.

The present invention has also been proposed on the basis of the aforementioned background and has another object to provide an image forming apparatus for forming a plurality of superposed toner images on an image retainer, which device is freed from insufficient cleaning thereof and from having the periphery of the image retainer blotted with the toner so that the quality of the image to be formed thereby can be improved.

Still another object of the present invention is to provide an image forming apparatus which is made compact and excellent in developing characteristics so that is can form a multi-color image of high quality.

The above-specified object is achieved by an image forming apparatus comprising a cleaning device for cleaning the surface of an image retainer after a plurality of superposed toner images having been formed on the image retainer have been transferred to a transfer member, wherein the improvement resides in that said cleaning device includes a cleaning blade and a rotary member positioned downstream of said cleaning blade in the moving direction of the surface of said image retainer such that the release of said rotary member from abutment against said image retainer is conducted after the release of said cleaning blade from the abutment.

In the cleaning device having a combination of the blade and the rotary member according to the present invention, the toner left on the image retainer can be cleaned and removed therefrom remarkably effectively by simple cleaning means which is constructed by bringing an elastic plate member made of urethane rubber, styrene-butadiene rubber or acrylonitrile rubber into abutment against the image retainer. Since the toner having passed downstream of said blade upon the release of this blade from its abutment is also removed by the aforementioned rotary member, moreover, the cleaning of the image retainer is executed sufficiently effectively. Since it is unnecessary to apply the bias voltage for removing the toner from a magnetic brush as in the case of the magnetic brush cleaning and to enlarge the size of a fur brush and turn it at a high speed as in the case of the fur brush cleaning, still moreover, the construction can be simplified and small-sized so that the production cost can be dropped.

A further object of the present invention is to provide a cleaning device having a blade member to be brought into and out of abutment against an image retainer, which device is enabled to clean effectively the toner left on the image retainer and to remove a strongly sticking substance (e.g., flattened paper powder capable of passing through the blade member) other than the residual toner thereby to ensure formation of a high-quality image while elongating the lifetime of a photosensitive member.

The above-specified object can be achieved by a cleaning device which comprises: first cleaning means arranged in the vicinity of a running image retainer and having a cleaning blade suitably timed to be brought into and out of abutment against said image retainer; and an elastic cleaning roller disposed downstream of said first cleaning means in the running direction of said image retainer for coming into and out of rotational abutment against the surface of said image retainer, which device is characterized in that said cleaning roller is released from abutment against said image retainer while an image is being formed.

According to the present invention, a rubber or foamed roller having an inner layer made of a sponge material of low hardness and an outer layer made of solid-state silicone rubber of higher hardness is arranged downstream of the blade member in the running direction of the image retainer, and said elastic cleaning roller has a function to come into and out of rotational abutment against the image retainer so that the toner or the like left on the portion of the image retainer cleaned by the blade is cleaned by the aforementioned elastic cleaning roller when the aforementioned blade member (which corresponds to the first cleaning means) is retracted apart from the image retainer.

BRIEF DESCRIPTION OF THE DRAWINGS

Other objects and features of the present invention will be made apparent from the following description taken with reference to the accompanying drawings, in which:

FIG. 1(*b*) is a block diagram showing the procedure for preparing an image memory of FIG. 1(*a*);

DESCRIPTION OF THE PREFERRED EMBODIMENTS

Embodiment 1

Figure 1A:
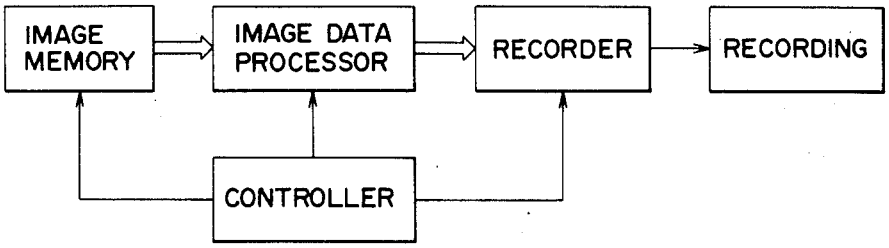
FIG. 1(*a*) is a block diagram showing the image forming procedure of an image forming apparatus according to the, present invention.
Figure 1B:
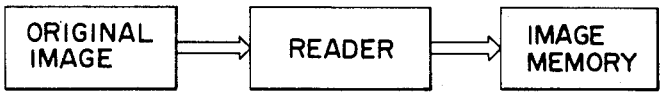

FIG. 1(*a*) is a basic block diagram showing the image forming apparatus based on the present invention. Image data are sent from an image memory to an image data processor, in which they are transformed into a type suitable for recording until they are sent to a recorder. This recorder adopts the electrophotographic type. A photosensitive member is formed with a mark so that an oscillator is reset when the mark is read out by a position detector constructed of an optical sensor. A controller controls the recorder in response to a clock pulse coming from the oscillator.

FIG. 1(*b*) is a basic block diagram showing means for reading out and storing an original image by a suitable reader according to the original image. This original image is exemplified most generally by an original but additionally by a still image coming from a TV camera or an image transmitted from another device through telephone lines or the like. The image memory to be used may be a floppy disk or a magnetic tape, for example.

Figure 2:
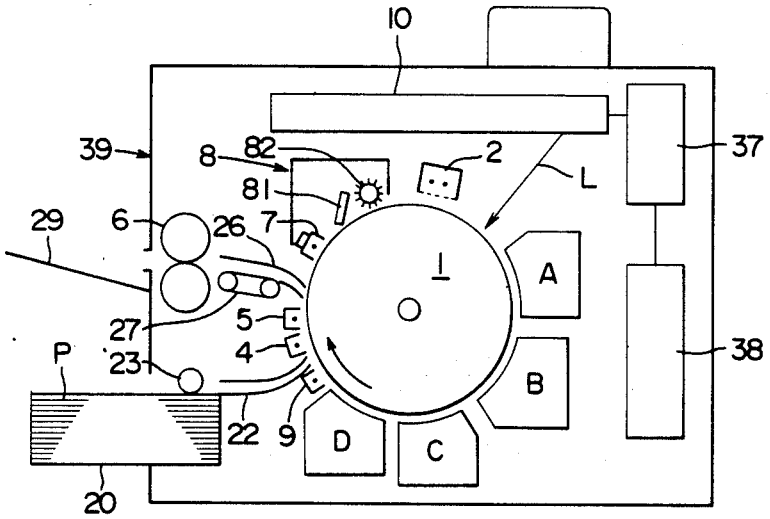
FIG. 2 is a schematic view showing an essential portion of the image forming apparatus.
Figure 15:
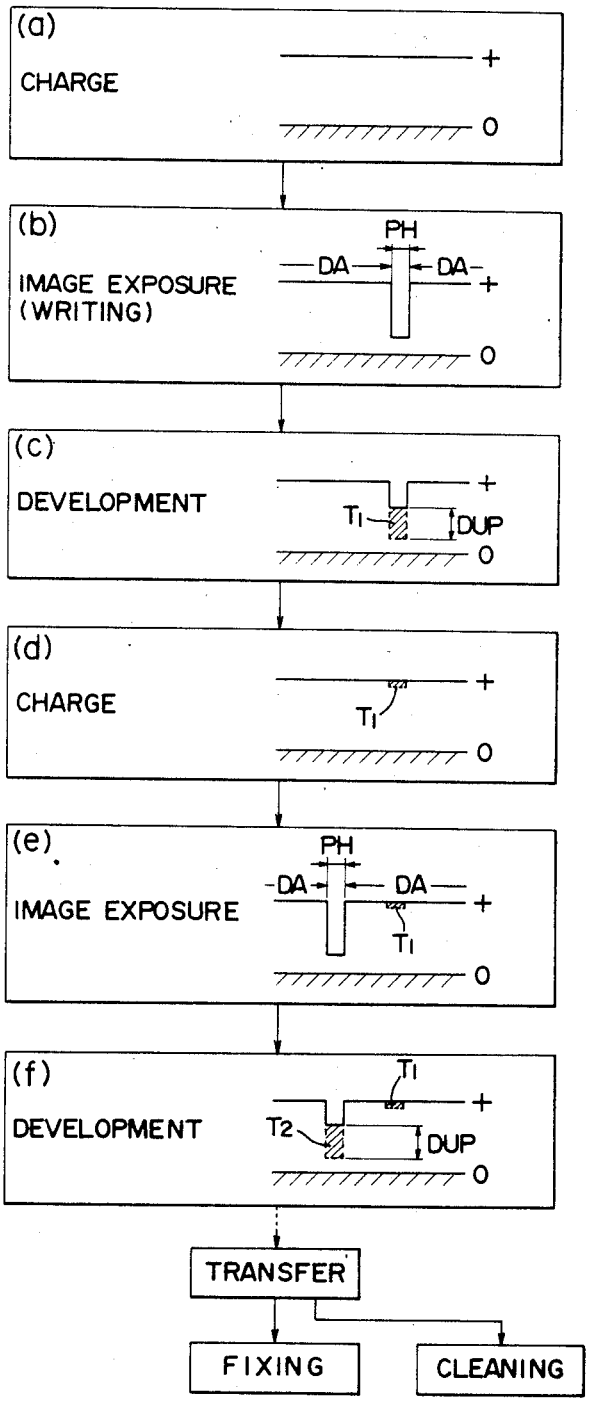
FIG. 15 is a flow chart showing a general image forming procedure.

FIG. 2 shows the construction of the multi-color image forming apparatus of FIG. 1(*a*), by which the multi-color image is formed in the following manner. A photosensitive member 1 has its surface charged uniformly by a scorotron charging electrode 2. Subsequently, an image exposing light L is emitted from a laser optical system 10 to irradiate the photosensitive member 1 to write the image therein. Thus, an electrostatic latent image is formed. This electrostatic latent image is developed by a developing device A containing Yellow toner. The photosensitive member 1 thus formed with the toner image is charged again uniformly by the scorotron charging electrode 2 and is exposed to the light L (as shown at (b) in FIG. 15). The electrostatic latent image thus formed is developed by a developing device B containing Magenta tonner. As a result, the photosensitive member 1 is formed thereon with a two-color toner image of the Yellow and Magenta toners. Likewise, cyan toner and black toner are sequentially developed in a superposed manner so that a four-color toner image is formed on the photosensitive member 1. This four-color toner image is charged by a pre-transfer electrode 9 and is transferred to recording paper P by a transfer electrode 4. The recording paper P is separated from the photosensitive member 1 by a separating electrode 5 and is fixed by a fixing device 6. On the other hand, the photosensitive member 1 is cleaned by a charge eliminating electrode 7 and a cleaning device 8.

In FIG. 2: reference numeral 37 indicates an image data processor; numeral 38 an image memory; and numeral 39 a recorder.

The cleaning device 8 is composed of a cleaning blade 81 and a fur brush 82. These components are held in non-contact with the photosensitive member 1 during the image formation and are brought into contact with the photosensitive member 1 to scrape off the toner left after the transfer when the photosensitive member 1 is formed with the multi-color image. After this, the cleaning blade 81 leaves the photosensitive member 1, followed by the fur brush 82 with a short delay. The fur brush 82 acts to remove the toner left on the photosensitive member 1 when the cleaning blade 81 leaves the photosensitive member 1.

In this multi-color image forming apparatus, the development of each color is conducted for each turn of the photosensitive member 1, and the exposure of each image has to be started from the identical position of the photosensitive member 1. On the other hand, none of the developing devices left unused during the image formation, the individual electrodes other than the charging electrode 2, the paper feeding device, the paper carrying device, and the cleaning device 8 exert actions on the photosensitive member 1.

Figure 3:
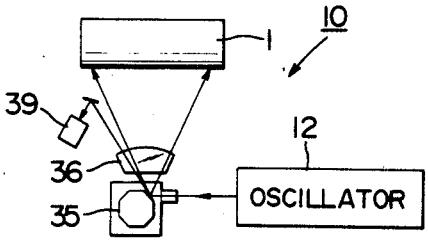
FIG. 3 a schematic view showing an essential portion of a laser beam scanner.

The laser optical system 10 is shown in FIG. 3, in which: letter 12 indicates a semiconductor laser oscillator; numeral 35 a rotating polygonal mirror; and numeral 36 an f-$\theta$ lens.

Figure 4:
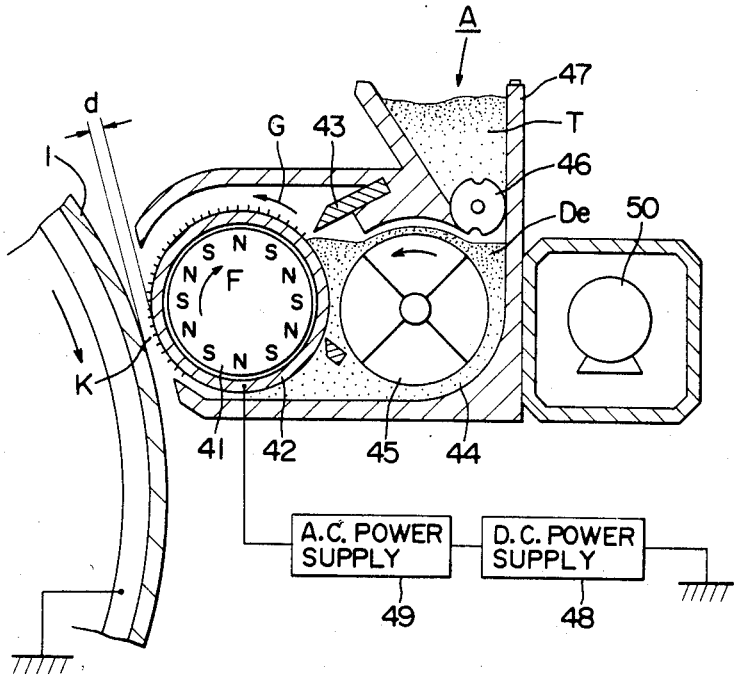
FIG. 4 is a sectional view showing a developing device.

Next, the developing devices to be used with the multi-color image forming apparatus of FIG. 2 are divided into four kinds which may be of identical or similar construction, as represented in section by the first developing device A in FIG. 4. A developer De is carried in the direction of arrow G as a result a magnetic roll 41 having six N and S poles turns in the direction of arrow F whereas a developer carrying sleeve 42 turns in the direction of the arrow G. The developer De has its thickness regulated by a head regulating blade 43, while it is being carried, to form a developer layer. In a developer reservoir 44, there is disposed an agitating screw 45 for sufficiently agitating the developer De, and the toner T is supplied from a toner hopper 47 by turning a toner feed roller 46 when the developer De in the developer reservoir 44 is consumed.

The gap between the sleeve 42 and the photosensitive member 1 is held such that the developer layer on the sleeve 42 may not contact with the photosensitive member 1. Between the sleeve 42 and the photosensitive member 1, there are connected in series a d.c. power supply 48 and an a.c. power supply 49 for applying a developing bias so as to effect a reversal development. The developing sleeve 42, the agitating sorew 45 and the magnetic roll 41 are turned by a drive motor 50.

On the other hand, the developer to be used in such machine is divided into a two-component developer composed of a toner and a carrier and a one-component developer composed exclusively of a toner. The two-component developer has to be administered in the amount of the toner relative to the carrier but has an advantage that the frictional charge control of the toner particles can be easily accomplished. Moreover, especially the two-component developer composed of a magnetic carrier and a non-magnetic toner need not contain a large amount of black magnetic material in the toner particles so that it can enjoy an advantage that a color toner of a magnetic material having not color turbidity can be used to form a clear color image.

The two-component developer to be used in the present invention is especially preferable to be composed of the magnetic carrier as the carrier and the non-magnetic toner as the toner in the following manner:

| Toner | |
|---|---|
| (1) Thermoplastic Resin: Binder 80 to 90 wt % | |
| Examples: | polystyrene, styrene-acryl copolymer, polyester, polyvinyl butyral, epoxy resin, polyamide resin, polyethylene, ethylene-vinylacetate copolymer, or |

-continued

| Toner | |
|---|---|
| | their mixture; |
| (2) Pigment: Coloring Agent 0 to 15 wt % | |
| Examples: | |
| Black: | carbon black; |
| Cyan: | copper phthalocyanine, or sulfonamide derivative dye; |
| Yellow: | benzidine derivative; and |
| Magenta: | Rhodamine B Lake or Carmine 6B; |
| (3) Charge Controller: 0 to 5 wt % | |
| Plus Toner: | mostly electron donor dye of nigrosine, alkoxylated amine, alkyl amide, chelate, pigment or 4th-class ammonium salt; |
| Minus Toner: | electron receiving organic complex, chlorinated paraffin, chlorinated polyester, polyester having excess acid radicals, or chlorinated copper phthalocyanine; |
| (4) Fluidizing Agent: | |
| Examples: | represented by colloidal silica or phosphobic silica, and silicone varnish, metallic soap or nonionic surface-active agent; |
| (5) Cleaning Agent: | |
| (for preventing the toner of the photosensitive member from filming) | |
| Examples: | metallic salt of fatty acid, oxidized silicic acid or surface-active agent of fluorine; |
| (6) Filling Agent: | |
| (for improving surface gloss of the image and reducing the cost for a raw material) | |
| Examples: | calcium carbonate, clay, talc or pigment. |

The developer may contain a magnetic material in addition to the above-enumerated materials so as to prevent the fogging and the toner dispersion.

As the magnetic powder, there has been proposed powder of ferrosoferric oxide, γ-ferric oxide, chromium dioxide, nickel ferrite or iron alloy having a particle size of 0.1 to 1 μm. At present, the ferrosoferric oxide is most frequently used and is contained by 5 to 70 wt % for the toner. Although the resistance of the toner is considerably varied in accordance with the kinds and amounts of the magnetic powder, the amount of the magnetic material is preferred to be not more than 55 wt % so as to ensure a sufficient resistance equal to or higher than $10^8$ Ωcm or more preferably $10^{12}$ μcm. In order to hold the clear color, on the other hand, the color toner is desired to contain 30 wt % or less of a magnetic material.

As a resin suitable for a pressure-fixing toner, an adhesive resin such as wax, polyolefins, ethylenevinylacetate copolymer, polyurethane or rubber is selected so that it may be plastically deformed to adhere to the paper by a force of about 20 kg/cm$^2$. A capsule toner can also be used.

The toner can be prepared with the above-specified materials by the method well-known in the art.

In order to form a more preferable image with the construction of the present invention, the toner particle diameter is usually desired from the relationship with the resolution to have a weight-averaged particle diameter about 50 μm or less. In the present means, the toner particle diameter is not limited on principle but may preferably have a value of 1 to 30 μm from the relationship with the toner dispersion and carriability. In the present embodiment, the toners in the four colors have a weight-averaged particle diameter of 10 μm.

Incidentally, the weight-averaged particle diameter is a value which is measured by with a Coulter Counter (which is the product of Coulter Electronics, Inc.).

Carrier

The carrier is basically exemplified by the toner composing materials specified above. In order to form fine points or lines or enhance the gradation, the carrier particles may preferably be particles composed of magnetic particles and a resin, such as a resin-dispersed system of magnetic powder and a resin or magnetic particles coated with a resin, or more preferably be rounded to have a weight-averaged particle diameter of 50 μm, or most preferably 5 to 30 μm. The present embodiment used carrier particles having a weight-averaged particle diameter of 50 μm for all the four colors.

Moreover, in order to prevent the problem that the charges are made liable by the bias voltage to be implanted into the carrier particles obstructing the excellent image formation so that they become liable to stick to the surface of the image retainer and so that the bias voltage is not sufficiently impressed, the carrier may have an insulating resistivity of $10^8$ μcm or more, or preferably $10^{13}$ μcm or more, or more preferably $10^{14}$ μcm or more and may have the above-specified particle diameter.

The carrier thus granulated is prepared of the magnetic material described in connection with the toner and a thermoplastic resin by either coating the magnetic material surface with the resin or forming particles of a resin containing dispersed fine particles of the magnetic material and by selecting the diameter of the particles thus obtained by the average diameter selecting means known in the prior art. In order to improve the agitatability of the toner and carrier and the carriability of the developer and to improve the charge controllability of the toner thereby to make it reluctant for either the toner particles or the toner particles and the carrier particles to aggregate, it is desirable to round the carrier. These rounded magnetic carrier particles are prepared by selecting the magnetic particles as round as possible and coating them with the resin, by using the magnetic particles as fine as possible and rounding the dispersed resin particles with hot wind or water, or by forming round dispersed resin particles directly by the spray dry method. Incidentally, the intrinsic resistances of the toner and the carrier are measured by the following method. Specifically, the resistances are determined by tapping the particles in a container having a sectional area of 0.50 cm$^2$, by applying a load of 1 kg/cm$^3$ to the tapped particles, by applying such a voltage between the load and the bottom electrode as will establish an electric field of $10^2$ to $10^5$ V/cm, by reading the current value flowing, and by conducting a predetermined calculation. At this time, the carrier particles have a thickness of about 1 mm.

Next, the developing method will be described in the following. The development may be conducted by a method of rubbing directly with a magnetic brush, but a non-contact developing method is desired on and after at least the second development, in which the developer layer on a developer carrier is kept away from rubbing the surface of the photosensitive member so that the toner image formed may be prevented from being damaged. According to this non-contact method, an alternating electric field is established in a developing region so that the development may be effected without rubbing the photosensitive member and the developer layer. This will be described in detail in the following.

In the repeated developments using the aforementioned alternating electric field, the photosensitive member having already been formed with the toner image can be developed repeated several times, the toner image formed on the photosensitive member at the preceding step is disturbed at the succeeding development unless a proper developing condition is set, or the toner having already sticked to the photosensitive member returns back to the developer carrier to steal into the succeeding-step developing device containing a developer in a color different from that of the preceding-step developer to raise a problem that color mixing will occur. In order to solve this problem, it is the principle that the developing operation is conducted without the developer layer on the developer carrier being rubbing or containing with the photosensitive member. For this operation, the gap between the image retainer and the developer carrier is held larger than the thickness of the developer layer in the developing region on the developer carrier (in case no potential difference is present in-between). Our experiments have revealed that a desirable developing condition is present in order to avoid the aforementioned problem more completely and to form each to image in a sufficient image density. It has been revealed according to the condition that an excellent image is difficult to form even if the gap d (mm) (which will be shortly referred to as the gap d) between the image retainer in the developing region and the developer carrier and the values of an amplitude $V_{AC}$ and frequency f (Hz) of the a.c. component of the developing bias for generating the alternating electric field are determined by themselves and that those parameters are closely related to one another.

The procedures will be described in the following.

The experiments were conducted by making use of the multi-color image forming apparatus shown in FIG. 2 to examine the influences of the parameters such as the voltage and frequency of the a.c. component of the developing bias of the developing device B when a two-color toner image was to be formed by the developing devices A and B.

The developments were conducted by using the developing devices A and B in the recited order.

The developer De charged at first into the developing device B was a one-component magnetic developer which was prepared by blending and pulverizing 70 wt % of thermoplastic resin, 10 wt % of pigment (i.e., carbon black), 20 wt % of magnetic material, and a charge controller to make an average particle diameter of 15 μm and by adding a fluidizing agent such as silica. The quantity of charge was controlled by the charge controlling agent.

Figure 5:
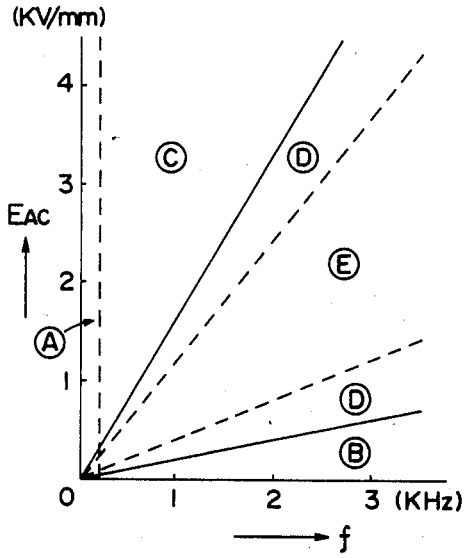
FIGS. 5 and 6 are graphs plotting the density characteristics against the varying intensity and frequency of an electric field.

The experiments were conducted under the aforementioned conditions varied, and the results can be rearranged, as shown in FIG. 5, in respect of the relation to the amplitude $E_{AC}$ and frequency of the intensity of the a.c. electric field.

In FIG. 5: circled A indicates a region in which uneven development is liable to occur; circled B a region in which the effect of the a.c. component does not appear; circled C a region in which the toner image already formed is liable to break; and circled D and E regions in which the effect of the a.c. component appears with a sufficient developing density but without any breakage of the toner image already formed, and the region E is the especially preferable region.

This result indicates that the amplitude and frequency of the intensity of the a.c. electric field have to fall within a proper region for developing a subsequent (at a succeeding step) toner image in a proper density without breaking the toner image formed previously (at a preceding step) on the photosensitive member.

On the basis of the experimental results thus far described, we obtained the conclusion that a subsequent development can be conducted in a proper density without disturbing the toner image formed already on the photosensitive member if the development is conducted under the condition satisfying the following relationship:

$$0.2 \leqq V_{AC}/(d.f) \leqq 1.6,$$

in case the amplitude and frequency of the a.c. component of the developing bias are designated at $V_{AC}$ (V) and f(Hz), respectively, whereas the gap between the photosensitive member 1 and the sleeve 42 is designated at d (mm). In order to attain a sufficient image density and prevent the toner image formed until the preceding step from being disturbed, it is more desirable to satisfy the following condition:

$$0.4 \leqq V_{AC}/(d.f) \leqq 1.2.$$

Of those regions, it is further desirable to satisfy the following region having a slightly lower electric field than that saturating the image density:

$$0.6 \leqq V_{AC}/(d.f) \leqq 1.0.$$

In case the frequency f of the a.c. component is set at 200 Hz or higher so as to prevent the uneven development due to the a.c. component and in case a turning magnetic roll is used as the means for feeding the developer to the photosensitive member, moreover, the frequency of the a.c. component is further desirable to be set at 500 Hz or higher so as to eliminate the influences of the beats which are caused by the a.c. component and the turns of the magnetic roll.

Next, the experiments were conducted with a two-component developer by the multi-color image forming apparatus shown in FIG. 2 like the foregoing experiments. The developer De contained in the developing device B is the two-component developer composed of a magnetic carrier and a non-magnetic toner, and said carrier was prepared by dispersing fine iron oxide into a resin to have physical properties such as an average particle diameter of 20 μm, a magnetization of 30 emu/g and a resistivity of $10^{14}$ μcm. Said toner was prepared by adding a small amount of charge controlling agent to 90 wt % of thermoplastic resin and 10 wt % of pigment (e.g., carbon black) to have an average particle diameter of 10 μm. Said toner was mixed at a ratio of 20 wt % to 80 wt % of said carrier to make the developer De. Incidentally, the toner was charged negative by the friction with the carrier.

Incidentally, the developing device B contained a two-component developer for the Yellow. The developing devices A and B were used in the recited order for the development.

Figure 6:
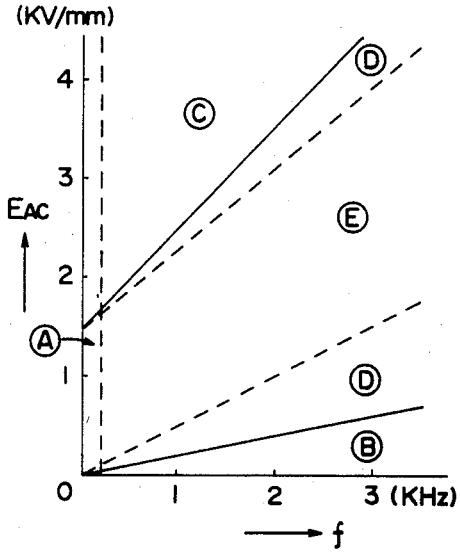

The experiments were conducted under the aforementioned conditions varied, and the results can be rearranged, as shown in FIG. 6, in respect of the relation to the amplitude $E_{AC}$ and frequency f of the intensity of the a.c. electric field.

In FIG. 6: circled A indicates a region in which uneven development is liable to occur; circled B a region in which the effect of the a.c. component does not appear; circled C a region in which the toner image already formed is liable to break; and circled D and E regions in which the effect of the a.c. component appears with a sufficient developing density but without any breakage of the toner image already formed, and the region E is the especially preferable region.

This result indicates that the amplitude and frequency of the intensity of the a.c. electric field have a fall within a proper region for developing a subsequent (at a succeeding step) toner image in a proper density without breaking the toner image formed at a preceding step on the photosensitive member.

On the basis of the experimental results thus far described, we obtained the conclusion that a subsequent development can be conducted in a proper density without disturbing the toner image formed already on the photosensitive member if the development is conducted under the condition satisfying the following relationship:

$$0.2 \leqq V_{AC}/(d.f)\ [(V_{AC}/d) - 1{,}500]/f \leqq 1.0,$$

in case the amplitude and frequency of the a.c. component of the developing bias are designated at $V_{AC}$ (V) and f(Hz), respectively, whereas the gap between the photosensitive member 1 and the sleeve 42 is designated at d (mm). In order to attain a sufficient image density and prevent the toner image formed until the preceding step from being disturbed, it is more desirable to satisfy the following condition:

$$0.5 \leqq V_{AC}/(d.f)\ [(V_{AC}/d) - 1{,}500]/f \leqq 1.0.$$

Of these relationships, moreover, if the following relationships are satisfied, a clearer multi-color image without any turbidity can be formed to prevent any toner in different color from being mixed into the developing device even after a mumber of operations:

$$0.5 \leqq V_{AC}/(d.f)\ [(V_{AC}/d) - 1{,}500]/f \leqq 0.8.$$

In case the frequency f of the a.c. component is set at 200 Hz or higher like the case using the one-component developer so as to prevent the uneven development due to the a.c. component and in case a turning magnetic roll is used as the means for feeding the developer to the photosensitive member 1, moreover, the frequency of the a.c. component has been revealed that it should be set at 500 Hz or higher so as to eliminate the influences of the beats which are caused by the a.c. component and the turns of the magnetic roll.

Although the image forming process based on the present invention has been exemplified above, the following methods are more preferably adopted solely or in any combination in accordance with the repetitions of the developments so as to develop subsequent toner images in a constant density sequentially on the photosensitive member 1 without breaking the toner image having formed on the photosensitive member 1:

(1) the method of sequentially using toners having larger quantities of charge;

(2) the method of sequentially reducing the amplitudes of the intensity of the electric field of the a.c. component of the developing bias; and (3) the method of sequentially increasing the frequencies of the a.c. component of the developing bias.

More specifically, the toner particles having the larger quantities of charge are the more liable to be influenced by the electric field. As a result if the toner particles having larger quantities of charge stick to the photosensitive member 1 at the initial development, they may return to the sleeve. Therefore, the foregoing method (1) prevents the aforementioned toner particles from returning to the sleeve at the subsequent development by using the toner particles having smaller quantities of charge for the initial development. The method (2) is a method for preventing the return of the toner particles having already sticked to the photosensitive member by weakening the electric field the more as the developments are repeated the more (i.e., at the more subsequent developments). As the concrete method for weakening the electric field, there are methods for sequentially dropping the voltage of the a.c. component and widening the gap d between the photosensitive member 1 and the sleeve 42 the more. The aforementioned method (3) is a method for preventing the return of the toner particles having already sticked to the photosensitive member by sequentially increasing the frequency of the a.c. component in accordance with the repetitions of the developments. These methods (1), (2) and (3) are effective if they are used by themselves by are more effective if they are so combined, for example, that the quantities of the toner charge are sequentially increased whereas the a.c. bias is sequentially lowered as the developments are repeated. In case the aforementioned three methods are to be adopted, on the other hand, a proper image density or color balance can be held by respectively adjusting the d.c. biases.

Figure 7:
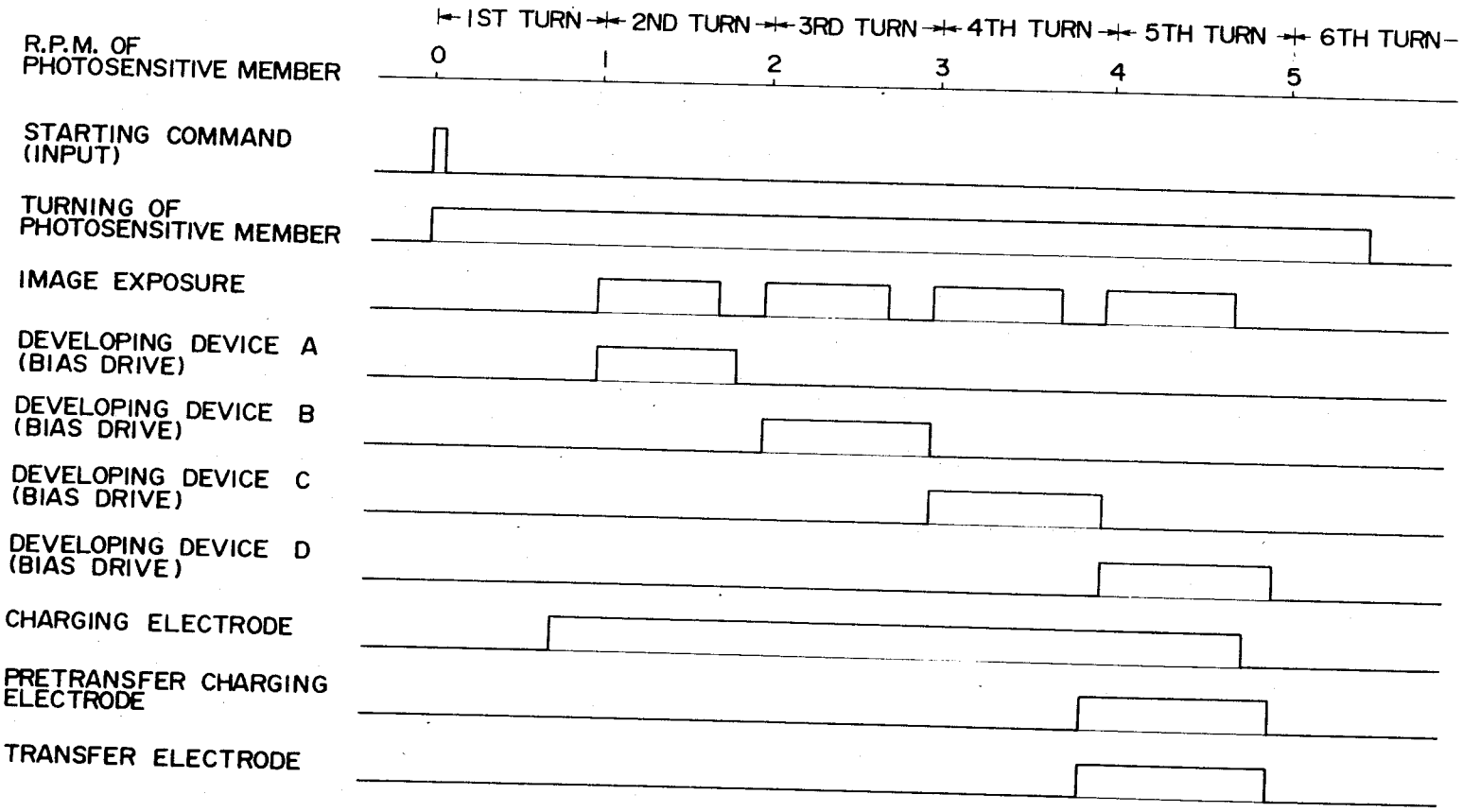
FIGS. 7 and 14 are timing charts depicting the operations of the individual portions of the image forming apparatus.

The multi-color image forming apparatus of FIG. 2 operates in accordance with the time chart of FIG. 7. While the image exposure (or writing) is being conducted, the control is made such that the developing bias, the motor for turning the developing sleeve, the magnetic roll and the agitating screw, or the individual discharge electrodes such as the charge electrodes are turned neither on nor off. The aforementioned control is performed by the usual sequence control of making a program in a time-series manner in a predetermined order and operating the aforementioned individual portions in accordance with that program.

As the image data, Yellow, Magenta, cyan and black components are sequentially inputted from the image memory. The image forming conditions are set, as follows:

| | |
|---|---|
| Image Forming Conditions | |
| Image Retainer: | |
| Photosensitive Layer: | a-Se; |
| Drum Diameter: | 120 mm; |
| Linear Velocity: | 220 mm; |
| Surface Potential: | |
| Charge Potential: | +700 V; |
| Exposed Portion Potential: | 0 V; |
| Image Forming Conditions: | |
| Light Source: | semiconductor laser; |
| Wavelength: | 700 nm; |
| Recording Density | 12 dots/mm; |
| Developing Device: | |
| Sleeve: | made of non-magnetic stainless steel, turned at linear velocity of 220 mm/sec; |
| Magnet: | 12 poles, turned at |

-continued

| | |
|---|---|
| | 1,000 r.p.m.; |
| Density of Magnetic Flux: | 700 Gausses at maximum on sleeve surface; |
| Developer: | |
| Carrier: | resistivity of $10^{14}$ Ωcm or more, magnetic powder dispersed resin system, average particle diameter of 20 μm, magnetization of 30 emu/g |
| Toner: | |
| Yellow: | resistivity of $10^{14}$ Ωcm or more, average particle diameter of 10 μm, average quantity of charge of 10 μc/g (or toner concentration of 20 wt %); |
| Magenta: | resistivity of $10^{14}$ Ωcm or more, average particle diameter of 10 μm, average quantity of charge of 11 μc/g (or toner concentration |
| Cyan: | resistivity of $10^{14}$ Ωcm or more, average particle diameter of 10 μm, average quantity of charge of 11 μc/g (or toner concentration of 20 wt %); |
| Black: | resistivity of $10^{14}$ Ωcm or more, average particle diameter of 10 μm, average quantity of charge of 12 μc/g (or toner concentration of 20 wt %); |
| Developing Conditions: | |
| Gap between Photosensitive Member and Sleeve: 1.0 mm; Thickness of Developer Layer: 0.2 to 0.6 mm (regulated by non-magnetic blade); | (common) |
| Developing Biases: | |
| A(Y)DC + 500V AC1.5KV (effective value) 2KHz; B(M)DC + 550V AC1.2KV (effective value) 2KHz; C(C)DC + 600V AC1.0KV (effective value) 2KHz; D(K)DC + 600V AC0.8KV (effective value) 2KHz; Developing Order: Y → M → C → K; and | |
| Other Processes: | |
| Transfer: Corona Transfer (with Pretransfer); Fixing: Heat Roller Type; and Cleaning: Blade + Fur Brush. | |

By forming a multi-color image under the above-specified conditions, a recorded image could always be formed stably without any phenomenon of image data disturbances.

Incidentally, in the multi-color image forming apparatus of FIG. 2, the image data are inputted from the image memory, but they need not resort to this method but may be obtained by transforming the original into electric signals by a solid-state image pickup element or by transmitting electric signals from another device.

Embodiment 2

Figure 8:
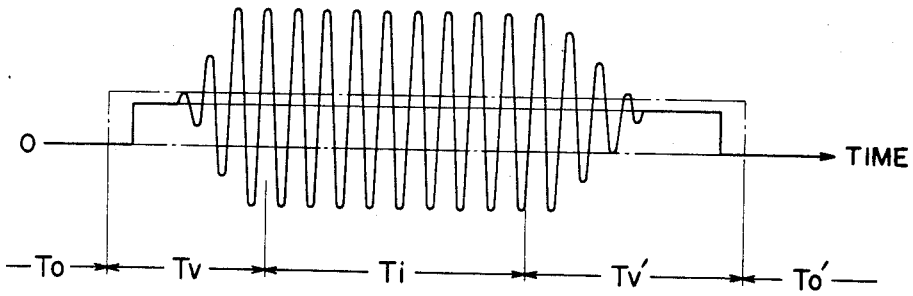
FIGS. 8, 9 and 10 are timing charts showing the sequential changes in a bias to be applied to the developing device.
Figure 9:
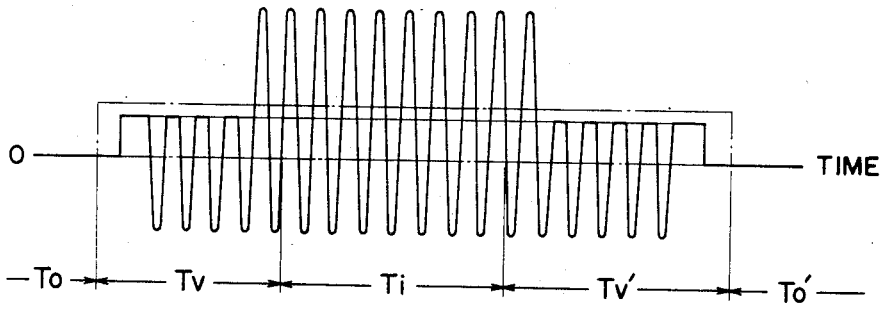
Figure 10:
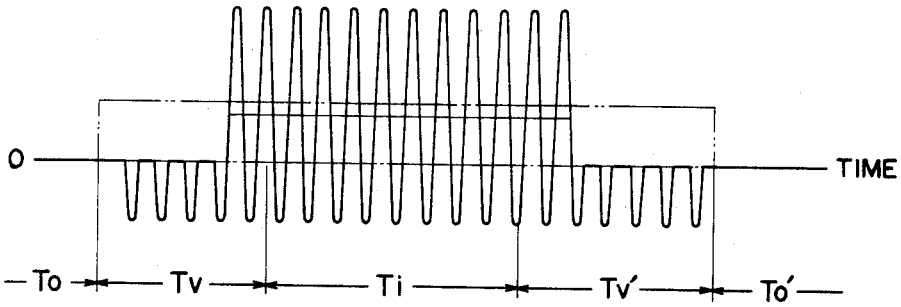

In FIGS. 8 to 10: letters To indicate a time band for which the uncharged region of the image retainer left uncharged by the charger 2 (as shown in FIG. 2) passes through a developing region K (as shown in FIG. 4); letters Tv a time band for which the non-image charged region of the image retainer 1 having been charged by the charger 2 but have received no image exposing light passes through the developing region K; letters Ti is a time band for which the image-formed region of the image retainer 1 having received the image exposing light passes through the developing region K; letters Tv' a time band for which a non-image portion succeeding the image-formed region passes through the developing region K; and letters To' a time band for which the uncharged region having been charged by the charger 2 passes through the developing region A. Moreover, FIG. 8 shows an example: in which a d.c. voltage is first applied for the time band Tv; in which an a.c. voltage of a constant period is then superposed with an amplitude being gradually increased; in which the image-formed region of the image retainer 1 passes at the state when the amplitude of the a.c. voltage reaches a predetermined value; in which the bias voltage having the superposed d.c. and a.c. voltages is maintained for the time band Ti; in which the amplitude of the a.c. voltage is attenuated to return to the application of only the d.c. voltage at the stage when the time band Tv' is entered; and in which the application of the d.c. voltage is interrupted before the uncharged region passes through the developing region K. If the one-directional electric field is thus generated before the arrival of the image-formed region at the developing region and if the vibrating electric field is made gradually strong to ensure the predetermined developing conditions, no noise is generated so that the latent image is always formed normally to maintain the predetermined vibrating electric field when the image-formed region passes through the developing region. This makes it possible to develop a clear toner image without any fogging and to minimize the power consumption, as necessary. FIG. 9 shows an example in which a half-wave rectified a.c. voltage is superposed on the d.c. voltage in place of gradually increasing and attenuating the amplitude of the a.c. voltage of the example of FIG. 8. Effects similar to those of the example of FIG. 8 can be attained in the example of FIG. 9, too. FIG. 10 shows an example, in which the one-directional electric field is generated by applying a pulsating voltage indicating only an identical polarity through the half-wave rectification of the superposed voltage to be applied for the development, in place of generating the one-directional electric field by previously applying only the d.c. voltage in the examples of FIGS. 8 and 9, thereby to ensure the roles identical to those of the gradual increase and attenuation of the a.c. voltage amplitude of FIG. 8 and the superposition of the half-wave rectified a.c. voltage of FIG. 9. In other words, the effects similar to those of the examples of FIGS. 8 and 9 can be attained in the example of FIG. 10.

Figure 11:
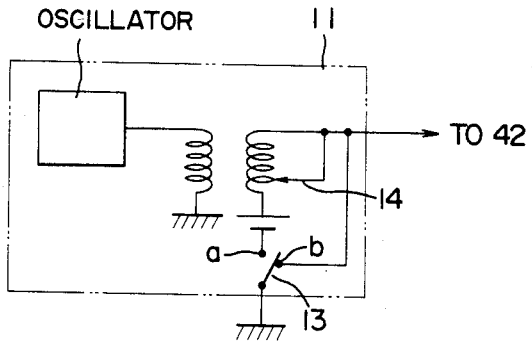
FIGS. 11, 12 and 13 are circuit diagrams showing the essential portion of a bias power supply circuit of the developing device.

The example of FIG. 8 can be practised by using the circuit shown in FIG. 11 as a bias power supply 11. More specifically, if a switch 13 is turned on at a contact a without operating an oscillator, a d.c. voltage is applied to the developer carrier 42. If the oscillator is operated to move a moving short-circuiting contact 14 of a secondary coil upward in the state in which the short-circuiting contact 14 is connected with the shown completely short-circuiting position, the a.c. voltage is superposed with its amplitude being gradually increased. If the moving short-circuiting contact 14 is returned from the position in which the amplitude of the a.c. voltage reaches a predetermined value, the amplitude of the a.c. voltage is attenuated to 0. If the switch 13 is turned on at a contact b, moreover, the application of the bias voltage to the developer carrier 42 is interrupted. Incidentally, the amplitude of the a.c. voltage may be gradually increased or attenuated at the side of the oscillator in place of using the moving short-circuiting contact 14 as the secondary coil.

Figure 12:
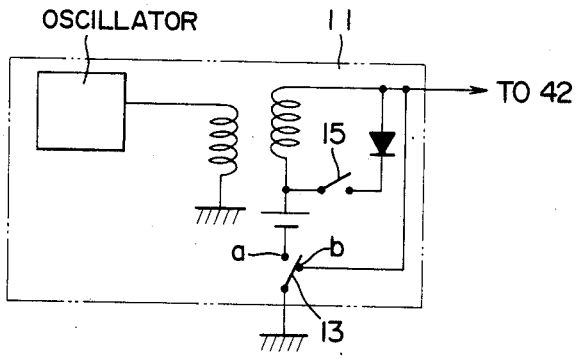

The example of FIG. 9 can be practised by using the circuit shown in FIG. 12 as the bias power supply 11. More specifically, if the switch 13 is turned on at the contact a without operating the oscillator, the d.c. voltage is applied to the developer carrier 42. If the oscillator is operated with a switch 15 of the rectifier being turned on, a half-wave rectified a.c. voltage is superposed on the d.c. voltage. If the switch 15 is turned off, the superposed voltage of the d.c. voltage and the a.c. voltage is applied. If the switch 15 is turned on again, the state is returned, in which the voltage having the half-wave rectified a.c. voltage superposed upon the d.c. voltage can be applied. Next, the bias voltage application of FIG. 9 is performed by interrupting the operation of the oscillator and by turning on the switch 13 at the contact b.

Figure 13:
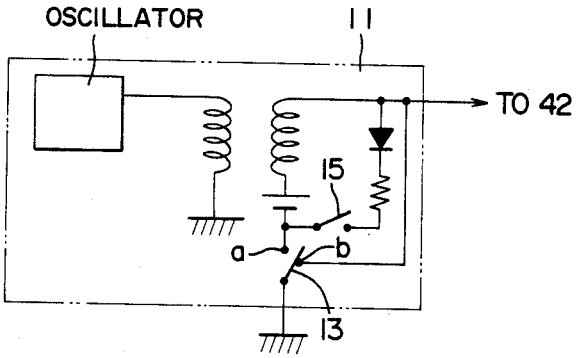

The example of FIG. 10 can be practised by using the circuit shown in FIG. 13 as the bias power supply 11. More specifically, if the oscillator is operated with the switch 15 of the rectifier being turned on at the contact b and with the switch 13 being turned on at the contact a, there is applied to a developer carrier 42 a pulsating bias voltage of one-directional polarity which is generated by rectifying the superposed voltage of the d.c. voltage and the a.c. voltage. If the switch 15 is then turned off, the bias voltage is the superposed voltage of the d.c. voltage and the a.c. voltage. If the switch 15 is turned on again, the pulsating bias voltage is returned so that its application is interrupted by turning on the switch 13 at the contact b.

Figure 14:
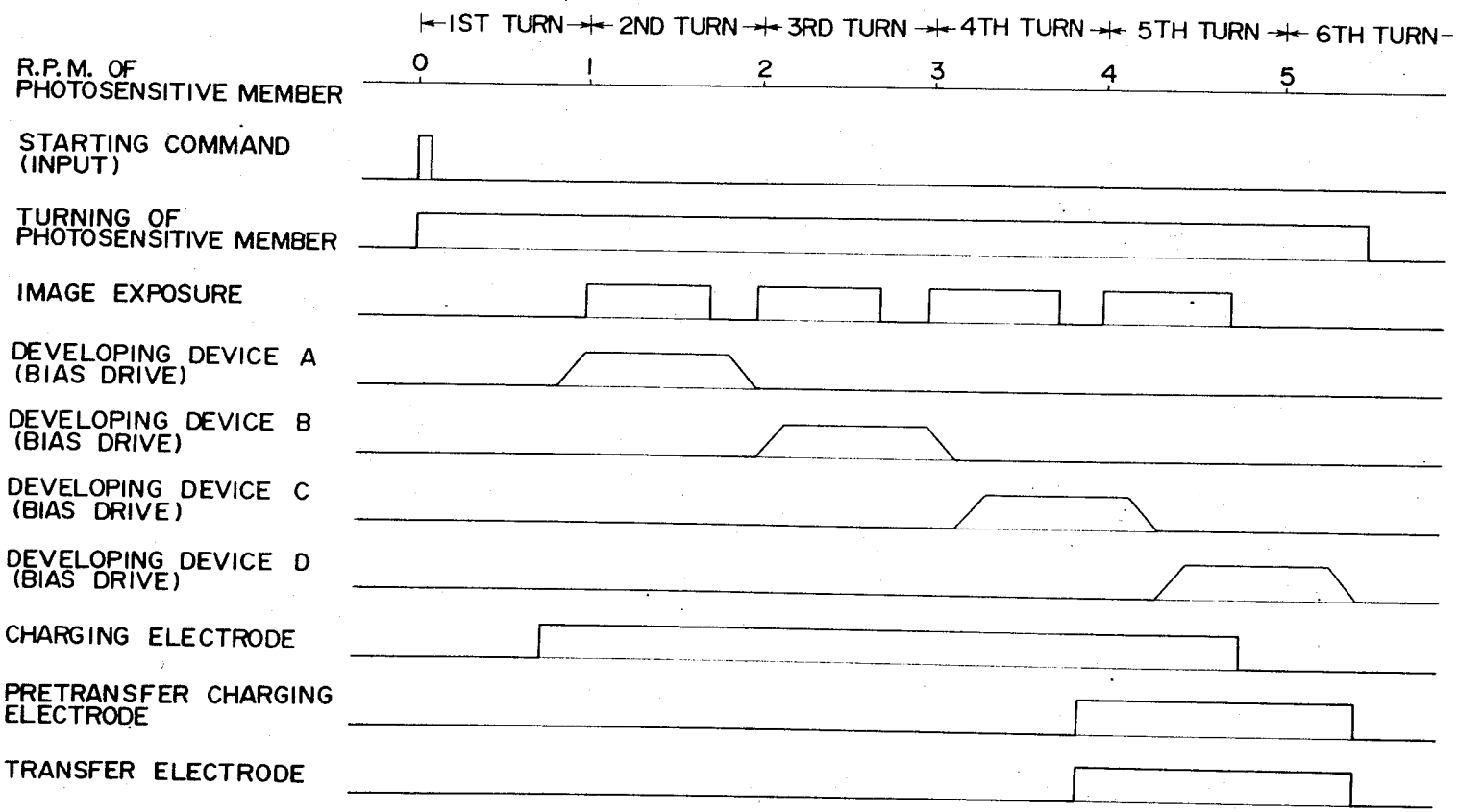

The operations thus far described are shown in the timing chart in FIG. 14.

In this example, the turns of the developer carrying sleeve 42 (as shown in FIG. 4) are conducted by the d.c. motor 50 (as shown in FIG. 4) which has its r.p.m. facilitated to change. As shown in FIGS. 9 to 11: the voltage is raised continuously or stepwise from 0 for the time band Tv; the constant voltage is held to ensure a constant-speed turn for the time band Ti; and the voltage is dropped continuously or stepwise to return to 0 when the time band Tv' is entered. In the timing chart of FIG. 14, the changes in the voltage applied to the motor are made identical in a time-series manner to the changes in the bias.

The conditions other than the aforementioned ones are similar to those of the foregoing Embodiment 1.

As a result, an excellent recorded image is attained stably.

For both the Embodiments 1 and 2, the electric changes of the image forming apparatus resort to the changes in the voltage. Changes to the electric quantities other than the voltage can be resorted to by controlling the charging electrodes with the changes in the current in place of turning on and off the charging electrodes or by controlling the turns of the developer carrying sleeve or the frequency through the use of an a.c. motor.

Figure 16A:
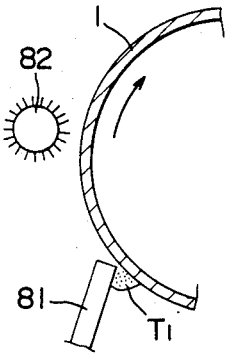
FIGS. 16(*a*) and 16(*b*) are sectional views showing the cleaning procedures using a blade and a rotary member according to the present invention.
Figure 16B:
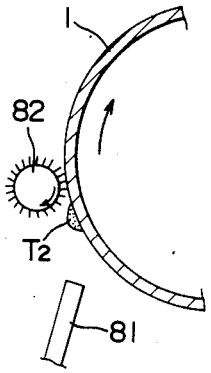

With reference to FIGS. 16(*a*) and 16(*b*) and Table 1, the conditions of the blade and turning member for the cleaning operations by the cleaning device of the present invention will be described in the following. FIG. 16(*a*) is a sectional view showing the state in which the blade is forced to abutment, and FIG. 16(*b*) is a sectional view showing the state in which the blade is released from its forced contact. In those Figures, reference letter $T_1$ indicates the toner which is being cleaned by the blade 81, and letter $T_2$ indicates the toner which has passed over the blade 81. Table 1 enumerates the conditions which can be taken by the blade 81 and the rotary member 82 while the cleaning is being conducted and when the cleaning is ended:

TABLE 1

| Member | Start of Cleaning | During Cleaning | End of Cleaning | After Cleaning |
|---|---|---|---|---|
| Blade | Abutment | Abutment | Release | Release |
| Turning Member | Abutment (Turn or Stop) | Abutment (Turn or Stop) | Abutment (Turn) | |
| | Release (Turn or Stop) | Release (Turn or Stop) | | Release (Turn or Stop) |

In Table 1, at the start of the cleaning operation, the blade 81 is brought into abutment against the image retainer 1 whereas the fur brush 82 may be brought into or out of abutment, but the blade cleaning operation is preferably carried out with the released state. Next, at the end of the cleaning operation, the fur brush 82 is forced to abutment against the surface of the image retainer 1 while being turned in the direction (as indicated by arrow) opposite to that of the movement of the surface of the image retainer 1, immediately before or after or simultaneously as the blade 81 is released, and at the latest before the toner $T_2$ arrives, to eliminate the toner $T_2$ which has passed below the blade 81, until the rotary member 82 is released.

EMBODIMENT 3

Figure 17:
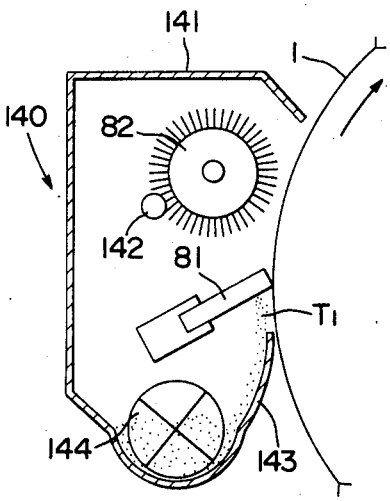
FIG. 17 is a sectional view showing a cleaning device of the present invention.
Figure 18:
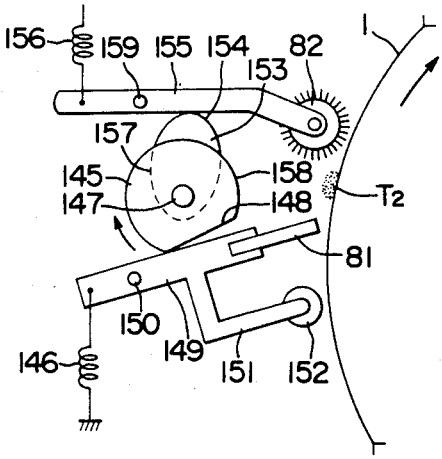
FIG. 18 is a sectional view showing a mechanism for connecting the blade and the rotary member.
Figure 19:
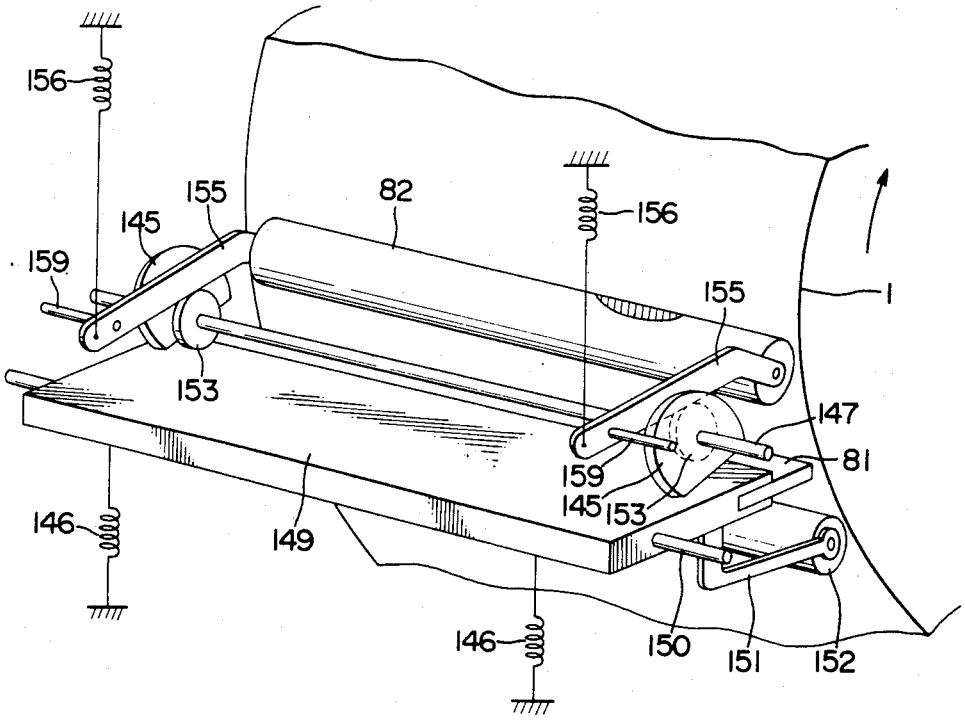
FIG. 19 is a perspective view showing the connecting mechanism of the blade and the rotary member.
Figure 20:
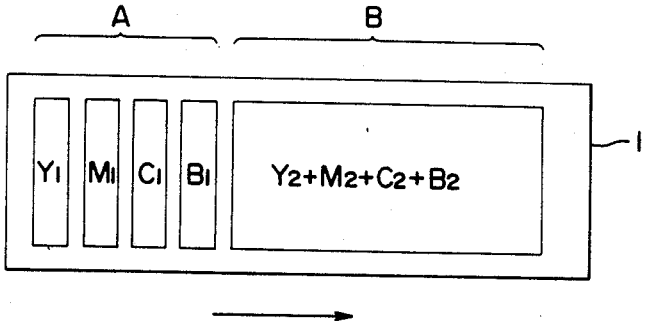
FIG. 20 is a top plan view showing the positions in which a reference image and an image for the image retainer are to be formed.
Figure 21:
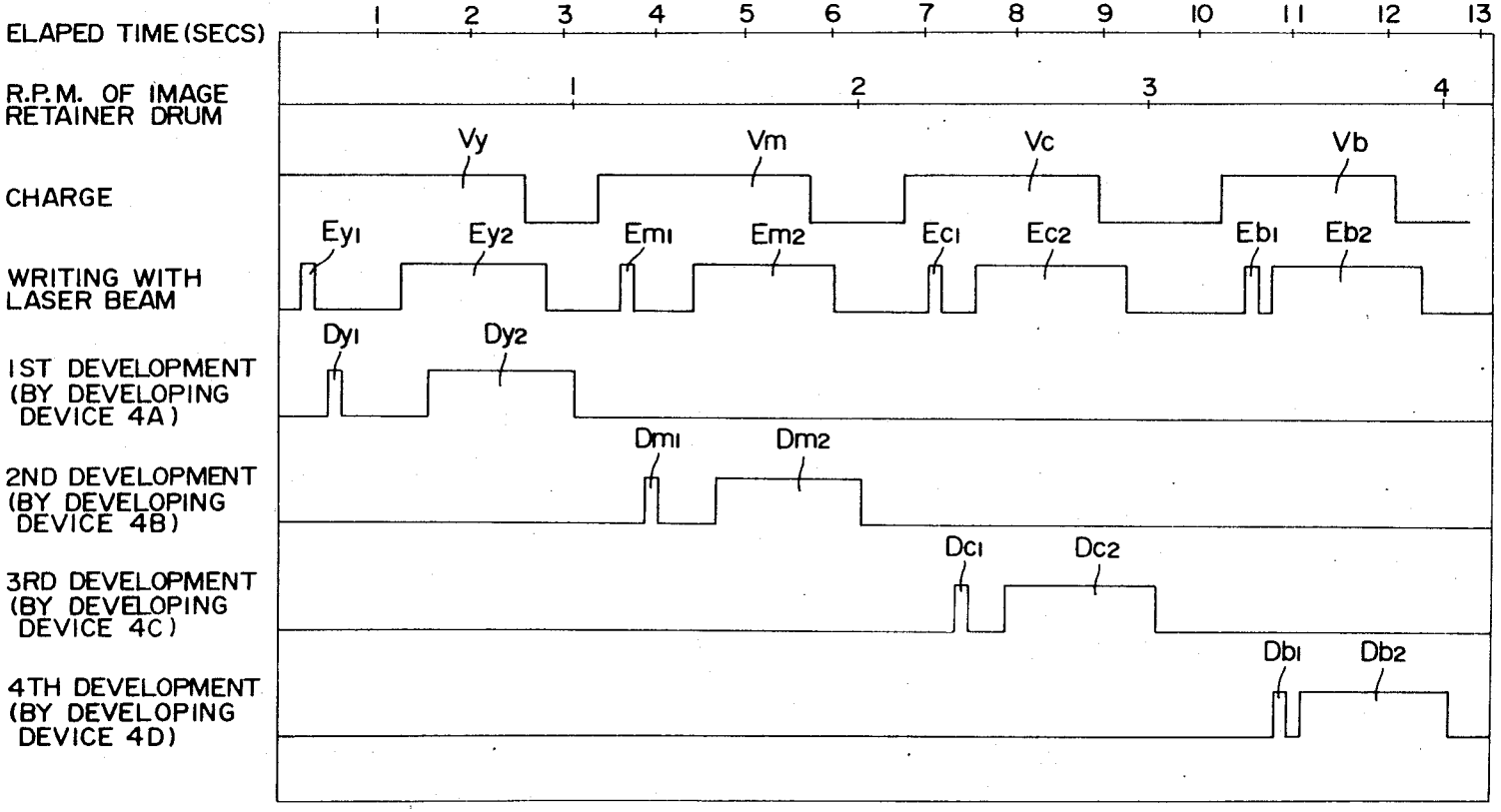
FIG. 21 is a timing chart for forming a multicolor image.

In FIGS. 17 to 21 for explaining the present embodiment: FIG. 17 is a sectional view showing the schematic structure of a cleaning device 140 which is attached in place of the cleaning device 8 of the image forming apparatus of FIG. 2; FIG. 18 is a sectional view for explaining the operations of bringing the blade and the rotary, member into or out of abutment; FIG. 19 is a perspective view for explaining the operations of the blade and the rotary member of the same; FIG. 20 is a top plan view showing the processes for forming a reference image and an image; and FIG. 21 is an image forming timing chart.

First of all, the structure of the cleaning device 140 to be attached to the image forming apparatus of the present embodiment will be described with reference to FIGS. 17 to 19, in which the same portions as those of FIGS. 16 and 2 are indicated at identical reference numerals. The cleaning device 140 of the present embodiment is constructed, as shown in FIG. 17, of: a container 141; the blade 81; the fur brush 82; a tapping rod 142 for tapping the fur brush 82; a guide member 143 for guiding the toner $T_1$ cleaned to the bottom of the container 141; and a screw conveyor 144 for conveying the toner $T_1$, which is recovered to the bottom of the container 141, to a disposal chamber. Next, the cleaning operations by the blade 81 and the rotary member 82 will be described with reference to FIGS. 18 and 19. After the surface of the image retainer 1 has been cleaned in the state of FIG. 17, the blade 81 is released from abutment against the surface of the image retainer 1 by the actions of a crescent cam 145 and a spring 146. More specifically, the crescent cam 145 is turned in the direction of arrow by the rotations of a shaft 147 timed with the image formation to bring its chord 148 into abutment against the upper edge of a blade plate 149 so that the blade is turned on a pin 150 fixed on the cleaning device frame by the action of the spring 146 to have its leading end directed upward. As a result, the blade 81 is separated and released from abutment against the surface of the image retainer 1. Indicated at numeral 152 is a follower roller which is hinged to the leading end of an arm 151 extending from the blade plate 149 so that it follows the movement of the surface of the image retainer 1 to rotate, when the blade plate 149 is forced to abut, thereby to prevent the toner from dropping from the cleaning device. Said follower roller 152 is released simultaneously with the release of the blade plate 149.

Incidentally, the aforementioned follower roller 152 is equipped with a scraping plate (although not shown in the drawings) for removing the toner therefrom. Alternatively, the follower roller 152 may be replaced by a plastic plate of Mylar, which is disposed in the vicinity of the photosensitive member.

Next, the aforementioned rotary shaft 147 is equipped with an elliptical cam 153 coaxially with the crescent cam 145. While the blade 81 is cleaning while being forced to abutment against the image retainer 1, the elliptical cam 153 has its shorter-axis face 157 abutting against the lower edge of an arm 155 of the fur brush 82 so that the arm 155 is turned on a pin 159 by a spring 156 to separate and release the fur brush 82 downward from the surface of the image retainer 1. Before the cleaning operation is ended so that the blade 81 is released from abutment against the surface of the image retainer 1 by the rotation of the shaft 147 in the direction of the arrow, however, the abutment of said elliptical cam 153 against the arm 155 is shifted from the shorter-axis face 157 to a longer-axis face 154 by the rotation of the elliptical cam 153 in the same direction. As a result, the fur brush 82 comes into abutment against the surface of the image retainer 1 to clean the toner $T_2$ which has passed below the blade 81. That rotary member 82 is usually made of a rotating fur brush or sponge roller planted with animal fur or fibers and may be rotated at all times but may preferably be rotated in the direction of the arrow when in the abutting operation. The fur brush 82 is rotated at 50 to 500 r.p.m. to completely remove the toner $T_2$. After this removal of the toner, the elliptical cam 153 is rotated so that its shorter-axis face 157 arrives to release the abutment. At this point of time, the blade 81 is left released, thus ending one process of the cleaning operation.

Thus, by disposing the elliptical cam 153 and the cresent cam 145 with a phase shift, it is possible to operate the cleaning blade 81 and the fur brush 82 operated with the phase shift and to remove even the toner which is left when the blade 81 is released.

In the cleaning device of the present embodiment, moreover, there is an intermediate state between the process in which the crescent cam 145 moves from a circumferential face 158 to the face of the chord 148 and the process in which the elliptical cam 153 moves from its longer-axis face 154 to its shorter-axis face 157. That intermediate state is a period for which the rotary member 82 does not wholly contact with the image retainer 1 and for which the toner image superposed on the image retainer 1 passes without damage below the cleaning device 140.

Next, the image forming process of the present embodiment will be described with reference to FIGS. 20, 21 and 2. The image retainer 1 of FIG. 20 has its drum-shaped surface shown in an expanded manner in a top plan view to have its front half surface A formed with reference latent images of Yellow ($Y_1$), Magenta ($M_1$), cyan ($C_1$) and black ($B_1$) and their developed toner images of the individual colors at separated different positions. The information from those reference toner images is fed back as the toner concentration, developing bias, charge potential and exposure light quantity for forming a subsequent image so that the latent images of Yellow ($Y_2$), Magenta ($M_2$), cyan ($C_2$) and black ($B_2$) are formed on the rear half surface B and so that the corresponding toner images are formed in a superposed manner on the same surface B.

In FIG. 21, there are shown the operations of the individual image forming apparatus when the present invention is put into practice by using the multicolor image forming apparatus of FIG. 2 equipped with the cleaning device of FIGS. 17 to 19. The image retainer 1 to be incorporated into the aforementioned apparatus is made by forming an amorphous silicon layer on the surface of the drum of aluminum to have a diameter of 120 mm. This image retainer 1 is turned at a speed of each turn for 3 sec or more in the direction of arrow and is formed for four turns with toner images of four colors of Yellow, Magenta, cyan and black in the superposed manner. At first, the image retainer 1 is uniformly charged with +600 V for a first turn by the corona charger 2 and is written with the Yellow information by the semiconductor laser beam scanner 10 to form a Yellow solid latent image $E_{y1}$ and a Yellow latent image $E_{y2}$. These latent images are subjected to a reversal development with the positive Yellow toner by the developing device A to form a Yellow solid toner image $D_{y1}$ and a Yellow toner image $D_{y2}$.

On and after the second turn of the image retainer 1, uniform positive charges Vm, Vc and Vb are applied similarly except that the positions for forming the solid latent images are different, as shown in FIGS. 20 and 21, and solid latent images $E_{m1}$, $E_{c1}$ and $E_{b1}$ and latent images $E_{m2}$, $E_{c2}$ and $E_{b2}$ are formed by the writing operations with the laser beams. These latent images are developed sequentially by the developing devices B, C and D to form a multicolor toner image. Since, at this time, the solid latent images ar developed prior to the developments of the latent images by the individual developing devices, a considerable amount of the toner in different color of the toners flowing in the developing devices is consumed. When the subsequent latent image is developed, the development is conducted by the toner which contains more toner supplied but less toner mixed, thereby to lighten the trouble due to the mixed toner.

Incidentally, the writing and developing operations of the aforementioned solid latent images may be interrupted in case the color mixing in the developing device is little, or the writing or developing interval may be elongated. Moreover, the writing positions of the solid latent images may be located after the latent images. Still moreover, the developing densities of the solid latent images may be suitably changed to control the consumption rate of the toner and may be used as the feedback to the control of the toner concentration, the charge potential and the developing bias from the developing density of the solid latent images.

In the subsequent image forming process, on the other hand, the image forming is preferably conducted in a manner to avoid the portion of the image retainer corresponding to the release of the fur brush or the like so that the cleaning by the fur brush and so on may cope with the case in which the cleaning is incomplete. Incidentally, in the description thus far made, the multicolor image is formed by a plurality of turns of the image retainer 1 but may be formed for one rotation of the image retainer 1.

EMBODIMENT 4

Figure 22:
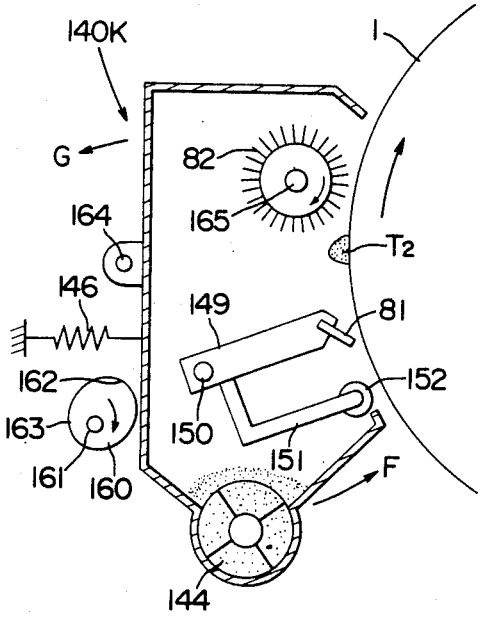
FIG. 22 is a sectional view showing another cleaning device of the present invention.

FIG. 22 is a view for explaining the present invention, which is featured by using a cleaning device 140K having the structure of FIG. 22 in place of the cleaning device 140 of the Embodiment 1 shown in FIGS. 17 to 19. Now, an elliptical eccentric cam 160 is rotated in the direction of arrow together with a shaft 161 hinged to the frame of the cleaning device to bring its longer-axis face 162 into abutment against the wall surface of the device 140K so that said device 140K is turned on a pin 164 fixed to the device frame. As a result, the device 140K has its upper half moved in the direction of arrow G and its lower half moved in the direction of arrow F. Since the blade 81 and the follower roller 152 are fixed to the side wall of the device 140K through the pin 150, they move integrally with the device 140K to come into abutment against the surface of the image retainer 1 thereby to conduct the cleaning operations. Simultaneously with this, the rotary member 82 is released from abutment against the surface of the image retainer 1. As the cam 160 is rotated to shift from its longer-axis face to its shorter-axis face 163, moreover, the blade 81 and the follower roller 152 are released from abutment against the surface of the image retainer 1, whereas the rotary member 82 is rotated together with a shaft 165 hinged to the side wall of the device 140K until it is forced to abut against the image retainer 1. Here, upon release of the blade 81 from the abutment, the toner $T_2$ having passed below the blade 81 is cleaned by the rotary member 82.

Moreover, a constant period, for which the cam 160 is turned to come to an intermediate state between its shorter-axis face 163 and its longer-axis face 162, has a region in which all the blade 81, the follower roller 152 and the rotarY member 82 are kept away from contact with the image retainer 1. For this period, the toner image is caused to pass through the cleaning device 140 in relation to the image forming timing. This passage is remarkably important when the multi-color image is to be formed by superposing the plural toner images.

EMBODIMENT 5

The cleaning device 8 is so disposed that it is positioned 10 cm in front of the leading end of a latent image at the instant when the trailing end of the latent image is positioned to be exposed to the light L.

The cleaning operation is conducted to control the cleaning device 8 such that the cleaning device 81 is actuated (namely, the cleaning blade 81 and the fur brush 82 are brought into abutment against the image retainer 1) after the end of the fourth latent image formation and before the leading end of the toner left on the image retainer 1 reaches the cleaning blade 81, and such that the cleaning device 8 is released (namely, the cleaning blade 81 and the fur brush 82 are brought away from the image retainer 1) at the instant when the trailing end of the aforementioned residual toner passes the fur brush 82. On the other hand, the laser beam scanner of FIG. 3 is so controlled that the first latent image formation in the next image process is started immediately after the release of the aforementioned cleaning device 8.

When the third development was conducted to form a four-color image on the image retainer 1, this color images was made liable to be transferred by the pretransfer charger 9 and the pretransfer exposing lamp so that it was transferred to the recording member P by the transfer member 4 and was fixed by the fixing device 6. The image retainer 1 from which the color image was transferred had its charge eliminated by the charge eliminating device 7 and had its surface cleared of its residual toner by the abutment of the cleaning blade 81 and the fur brush 82 of the cleaning device 8. The one cycle of the color image recording was completed at the instant when the surface formed with the color image passed the cleaning device 8.

EMBODIMENT 6

Figure 23:
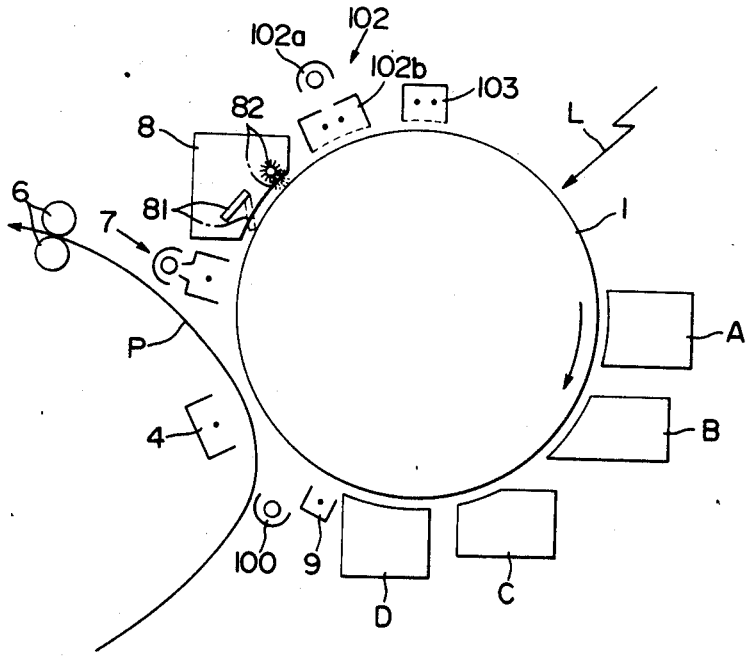
FIG. 23 is a schematic view showing an essential portion of the image forming apparatus according to another embodiment of the present invention.

In this embodiment, the charger 2 of the image forming apparatus of FIG. 2 is replaced by two chargers: a primary charger 102 having a combination of a lamp **102*a* for irradiating the surface of the image retainer 1 and a corona discharger 102*b*; and a secondary charger 103 having a corona discharger, as shown in FIG. 23**.

Here, the primary charger 102 need not always be equipped with the lamp **102*a* if the photoconductive and photosensitive layer 1*b* of the image retainer 1 has such a semiconductor characteristic as exhibits a rectifying action of implanting charges from the base member 1*a***.

The present invention should not be limited to the example, in which the second and subsequent electrostatic image formations are undergone by making use of the first primary and secondary charges, but can generally be exemplified by the primary and secondary charges again upon each of the second and subsequent electrostatic image formations, or either by eliminating the preceding charges by the charge eliminating device 7 or by conducting the secondary charge in a manner to erase the preceding electrostatic image and to compensate the dark decay before each of the second and subsequent electrostatic image formations. Especially in case either the primary and secondary charges or only the secondary charge is undergone again without eliminating the preceding charges, the scorotron corona discharger capable of stabilizing the charging operation even in the presence of the preceding charges may be preferably used as the corona dischargers of the primary charger 102 and the secondary charger 103. The repeated executions of the primary and secondary charges upon each formation of the electrostatic image are desired especially in case the gradation reproductivity is stressed or in case the image exposing light L is slit or flashed. On the other hand, the NP or KIP method can be adopted, in which the electrostatic image is formed by conducting the image exposure simultaneously with the secondary charge after the primary charge and by subsequently conducting the exposure of the whole surface. In the several methods thus far described, the potential of the electrostatic image can be so controlled in dependence upon the relative intensities of the primary and secondary charges that the exposed portion and the unexposed portion may take identical or opposite polarities, but the latter, i.e., the opposite polarities are preferred taking the easiness of development into consideration.

The electrostatic image thus formed upon the second turn is developed by such one of the developing devices A to D as has a color corresponding to that of the image exposing light L forming it but different from the color of the previous development. Likewise, upon the third turn of the image retainer 1, too, the formation of the electrostatic image and the development of the electrostatic image but by another developing device are conducted to form a color image in which toner images in different colors are superposed on the image retainer 1. Moreover, the surface of the image retainer 1 thus subjected to the final development has its toner images charged, if necessary, by the corona discharger and further irradiated by the pretransfer lamp 100 so that the color image can be easily transferred to the recording member P by means of the transfer member 4. The color image thus transferred to the recording member P is fixed to the recording member P by means of the fixing device 6. The surface of the image retainer 1, from which the color image has been transferred, has its charges eliminated by means of the charge eliminating device 7 and has its residual toners removed by the abutment of the cleaning blade 81 and the fur brush 82 of the cleaning device 8, which have been apart therefrom until that time. At the instant when that surface portion of the image retainer 1, which has been formed with the color image, passes the cleaning device 8, the one color image recording cycle is completed by the separations of the cleaning blade 81 and the fur brush 82 from the surface of the image retainer 1.

All the color images thus recorded repeatedly were so clear with their respective colors exhibiting sufficient densities that their misregistrations in the individual colors could not be recognized with the naked eyes.

As to the foregoing Embodiments, the position of the cleaning device 8 was changed, and the abutment of the cleaning blade 81 and the fur brush 82 against the image retainer 1 was started immediately after the end of the final development or released immediately before the initial charging operation. Neither the misregistration of the color image of the different colors nor the changes in the image densities were observed so that a color image of higher quality was formed.

Figure 24:
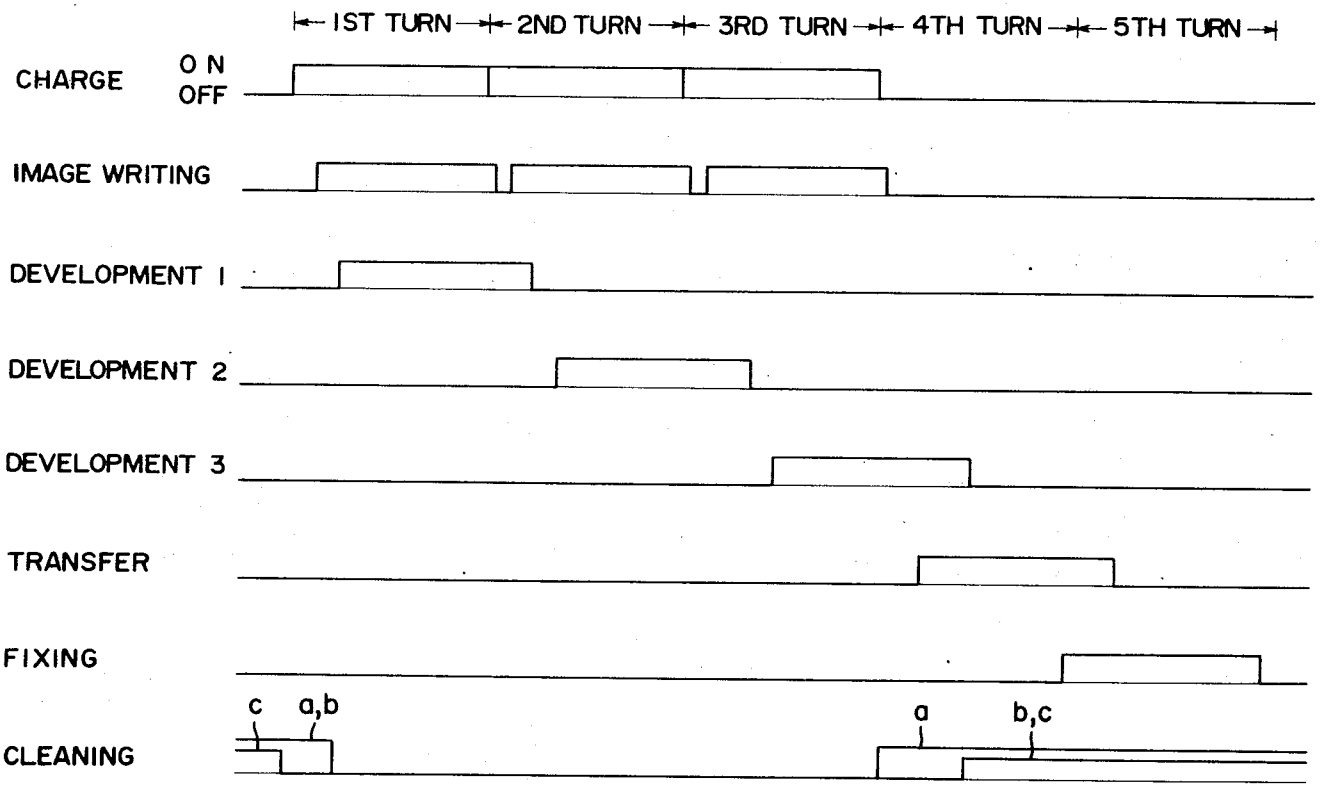
FIGS. 24, 25 and 26 are timing charts showing the operations of individual portions of the image forming apparatus.

By taking up the Embodiment 1 as an example, the image forming process is shown by a timing chart in FIG. 24. In FIG. 24: a curve a indicating the cleaning operation shows an example in which the operation of the cleaning device was started immediately after the final formation of the latent image; a curve b shows an example in which the above-specified operation was started immediately after the final development; and a curve c shows in addition to the example of the curve b an example in which the same operation was released immediately before the initial charge.

Figure 25:
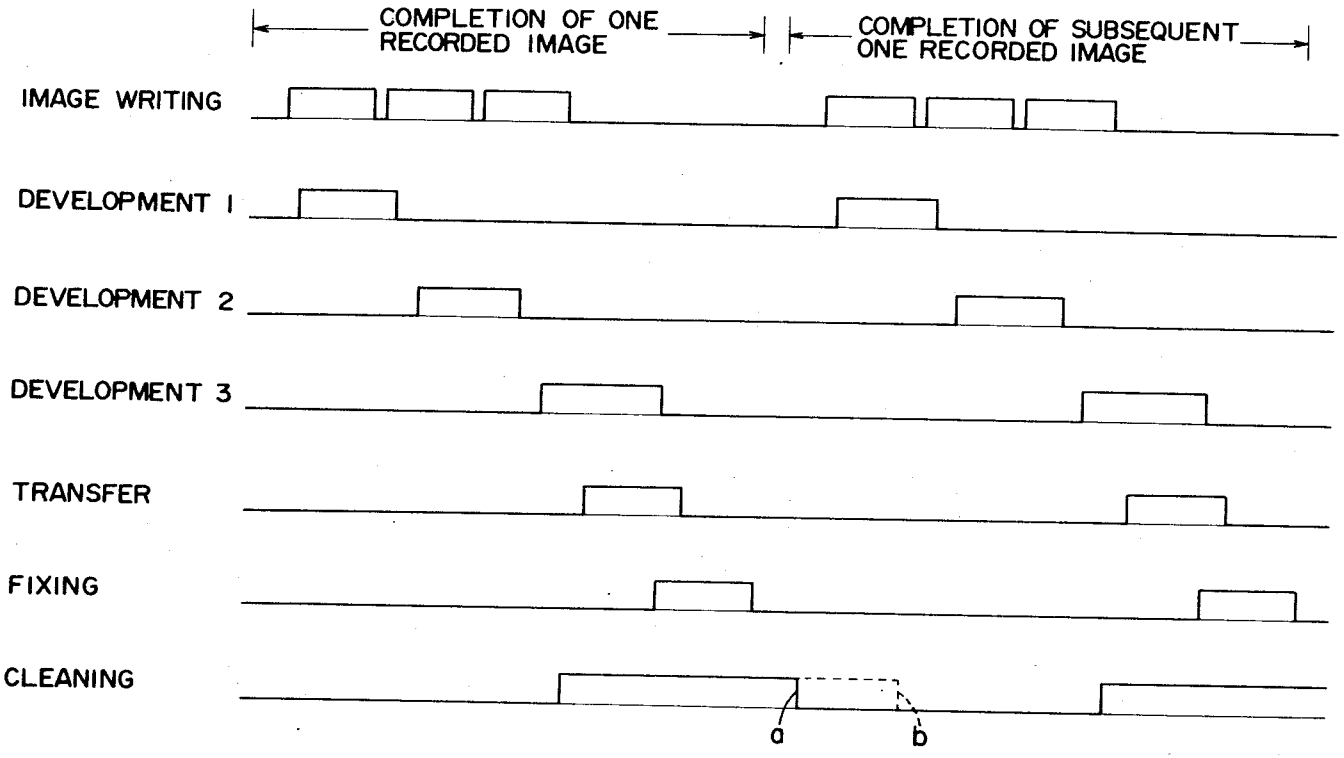
Figure 26:
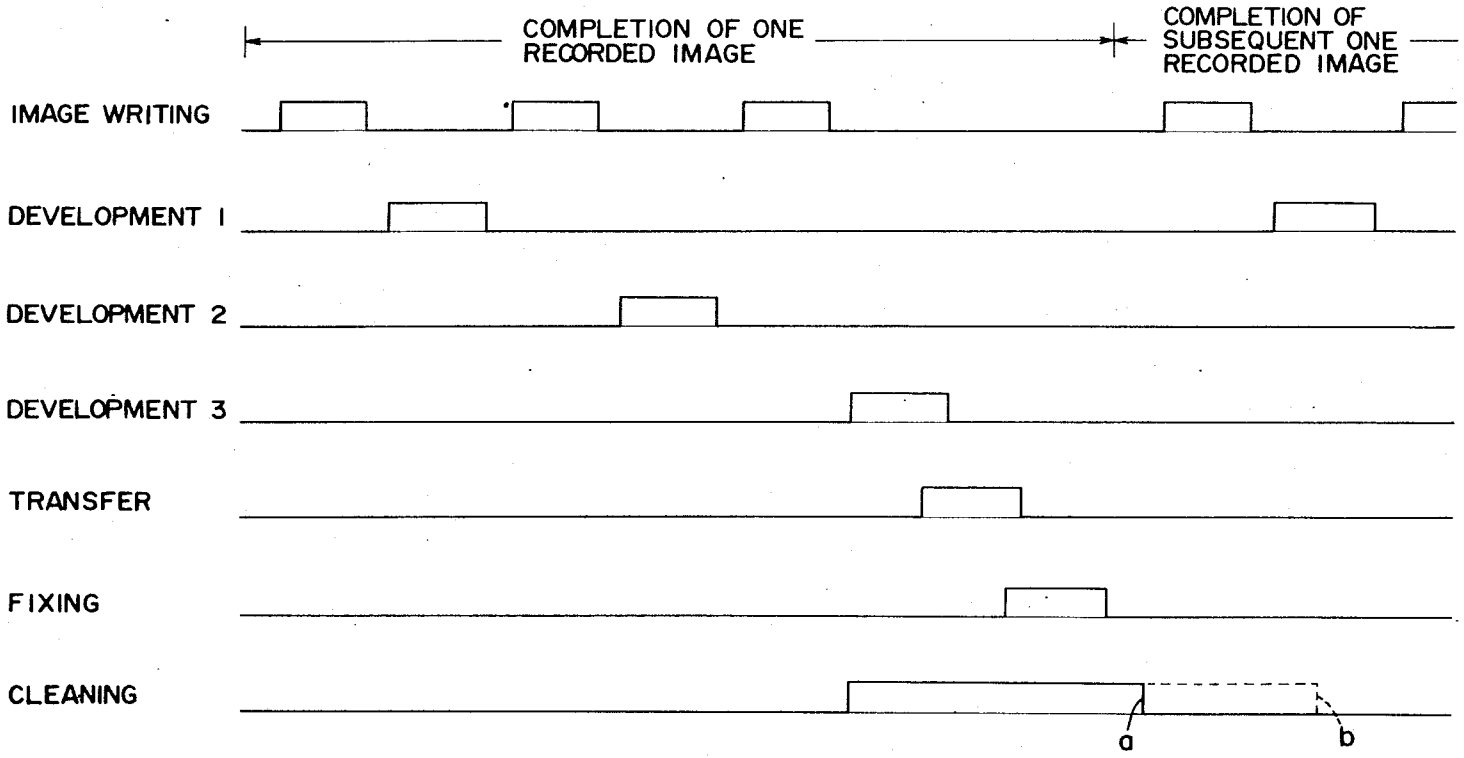

In FIGS. 24, 25 and 26, moreover, the development was conducted with the Yellow, Magenta and cyan toners by means of the three (which may be all) of the developing devices A, B, C and D shown in FIGS. 1 and 23 to make a black color with those three colors. This black color can be exhibited more clearly if all the four developing devices are used by additionally using a black toner. In this modification, the turns of the image retainer 1 for obtaining the recorded image is four for one cycle.

Thus, in the aforementioned examples, all the recorded images obtained are clear with a sufficient density but without any color misregistration, and no spare time to turn the image retainer only for the cleaning operation having no relation to the image formation is required for continuously forming the recorded images after all the processes except the cleaning operation have been ended.

Figure 27:
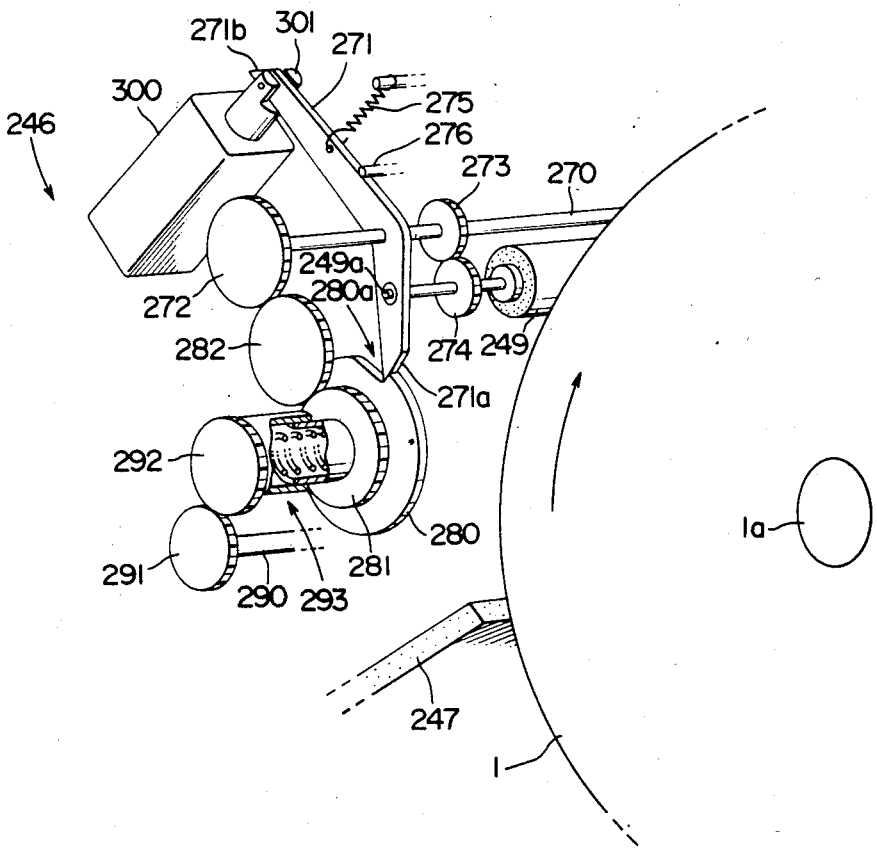
FIGS. 27 and 28 are perspective views showing essential portions of the cleaning device according to another embodiment of the present invention.
Figure 28:
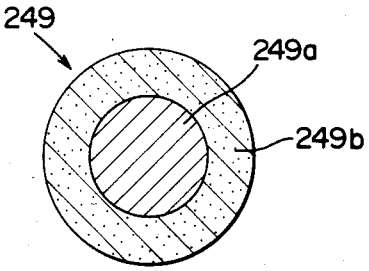
Figure 29:
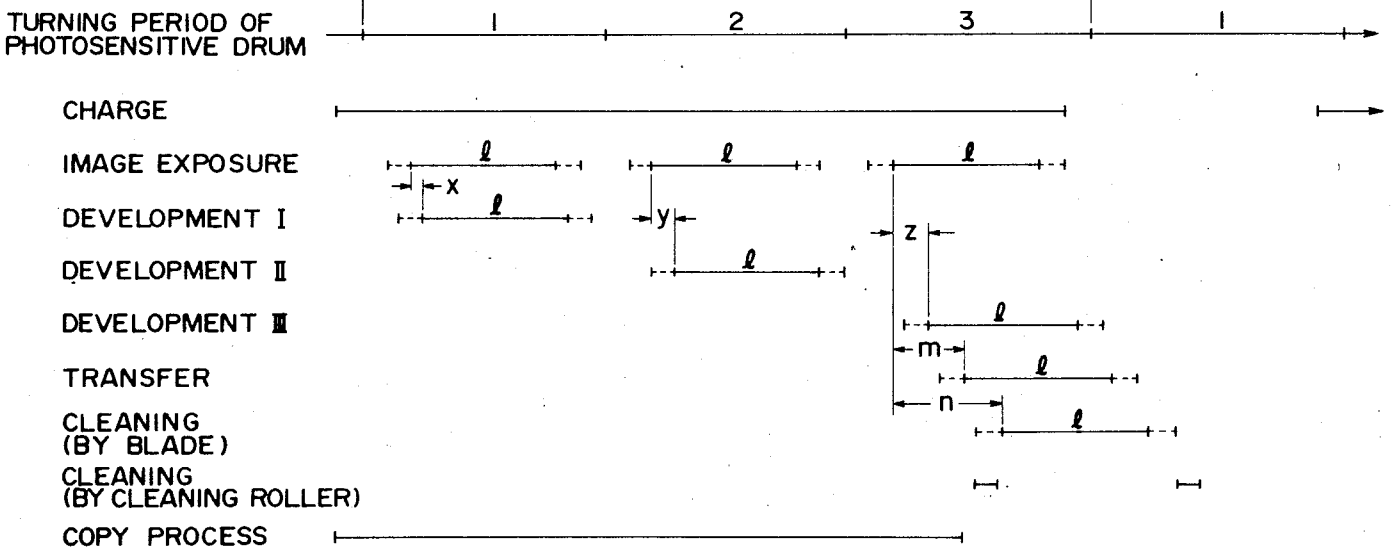
FIG. 29 is a timing chart showing the operations of a color image forming apparatus equipped with the aforementioned cleaning device.

A further embodiment of the present invention is shown in FIGS. 27 to 29.

In FIG. 27, reference numeral 247 indicates a cleaning blade acting as a first cleaning member to be forced to abut against the circumference of the aforementioned photosensitive drum 1 when in the cleaning operation, and numeral 249 indicates an elastic cleaning roller arranged downstream of the aforementioned cleaning blade 247 so that it is forced to abut against the circumference of the photosensitive drum 1 for respectively predetermined time periods when said cleaning blade 247 is brought into and out of abutment. The aforementioned elastic cleaning roller 249 has its bearing roller **249*a* borne movably by a stop lever 271, which is fixed on a rotary shaft 1*a* of the photosensitive drum 1, so that it can be forced to abut against the circumference of the photosensitive drum 1 by the counterclockwise turns of said stop lever 271. Incidentally, this stop lever 271 is attached to each of the two end portions of the aforementioned elastic cleaning roller 249 to arrange this cleaning roller 249 correctly in parallel with the circumference of the photosensitive drum 1. In a position to engage with one leading end 271*a* of the aforementioned stop lever 271, on the other hand, there is rotatably disposed a cam plate 280 which has a notched portion 280*a* integrated with a gear 281 so that it can be rotationally driven by the directional connection from a gear 291 on a drive shaft 290 guided from the body of the image forming apparatus through a gear 292 and a spring clutch 293. The rotations of the aforementioned drive shaft 290 are further transmitted from the aforementioned gear 281 through an intermediate gear 282 to a gear 272 fixed on the end portion of the aforementioned turning shaft 270 so that the aforementioned elastic cleaning roller 249 is rotated by the meshing engagement between a gear 273 fixed to the aforementioned turning shaft 270 and a gear 274 fixed to the aforementioned bearing shaft 249*a***.

On the other hand, a plunger 301 of a solenoid 300 is connected to the other leading end **271*b* of the aforementioned stop lever 271. When said solenoid 300 is turned on, its plunger 301 is actuated so that the aforementioned stop lever 271 abutting against a pin 276 is turned counter-clockwise by a tension spring 275 to force the aforementioned elastic cleaning roller 249 to abut against the circumference of the photosensitive drum 1, as has been described hereinbefore, and so that the leading end 271*a* of the aforementioned stop lever 271 releases the notched portion 280*a* of the aforementioned cam plate 280 from its engagement. FIG. 27 shows the state in which the photosensitive drum 1 is being subjected to the copying process including the charge, exposure, development and transfer so that both the aforementioned cleaning blade 247 and elastic cleaning roller 249 are retracted and spaced from the circumference of the photosensitive drum 1 and so that the rotations of the aforementioned drive shaft 290 are not transmitted to the aforementioned elastic cleaning roller 249 because the spring clutch 293 is kept inoperative by the retention of the aforementioned cam plate 280**.

Next, the operations will be described in the following. Before the leading end of the toner image lying on the circumference of the photosensitive drum 1 and having been subjected to the transfer reaches the position of the aforementioned cleaning blade 247, this cleaning blade 247 is forced to abut against the circumference of the photosensitive drum 1 by its forcing mechanism (although not shown in the drawings) to start separation of the residual toner. Simultaneously with this, the aforementioned solenoid 300 is turned on to turn the aforementioned stop lever 271 counterclockwise.

As a result, the aforementioned cam plate 280 is released from its retention and is rotated counterclockwise through the aforementioned spring clutch 293 by the clockwise driving rotations of the aforementioned drive shaft 290 to force the aforementioned elastic cleaning roller 249 to abut against the circumference of the photosensitive drum 1, while rotating it clockwise, through the aforementioned individual gears 282, 272, 273 and 274.

As a result, the toner powder or cluster, which is formed upon the abutment of the cleaning blade 247, is efficiently removed by the rubbing actions of the aforementioned elastic cleaning roller 249 rotating with a high velocity difference in the direction opposed to the carrying direction of the toner. Likewise, when the cleaning blade 247 is released from its abutment, too, the aforementioned solenoid 300 is turned on again to remove the toner powder or cluster left on the circumference so that the photosensitive drum 1 is efficiently cleaned.

FIG. 28 shows one example of the structure of the aforementioned elastic cleaning roller 249. An elastic outer layer **249*b* lined with a foamed polyurethane resin having a hardness of about 20° and a thickness of 3 mm is formed on the circumference of the bearing shaft 249*a* made of metal. The outer layer 249*b* is constructed to have a nipping quantity of about 3 mm relative to the circumference of the photosensitive drum 1 under the abutting load of about 200 g. Under this condition, the elastic cleaning roller 249 is rotated in the direction opposed to that of the photosensitive drum 1, as has been described above, and at a circumferential velocity half as high as that of the drum 1. As a result, it has been confirmed that the elastic cleaning roller 249 can remove remarkably efficiently the foreign matters such as not only the residual toner separated by the aforementioned cleaning blade 247** but also the aforementioned paper powder, talc, rosin or another substance made by the corona charge and that the damage of the photosensitive member was very light.

The color image forming sequence of the color image forming apparatus equipped with the cleaning device of the present invention will be described with reference to the time chart of FIG. 29. Upon the rotations, the photosensitive drum 1 having been charged in advance by a short time period is subjected for a first period to the image exposure with the aforementioned first color signals and to a development I with a time delay x. After this, the photosensitive drum 1 enters a second period for which it is subjected to the image exposure with the aforementioned second color signals and to a development II with a time delay y. For a third period, the photosensitive drum 1 is subjected to the image exposure with black signals and to a development III with a time delay z to form the color image.

Here: the time x, y and z are time periods required for the photosensitive drum 1 to move from the image exposure position to reach the position where it receives each of the developments; letter m indicates a time period required for moving from the image exposure position to a transfer electrode 250; and letter n indicates a time period required to move the image exposure position to a cleaning device 246. Moreover, letter l indicates a time period required for the whole image surface of an original to pass a fixed point such as the image exposure position or the development position. The operations such as the image exposure, development, transfer or cleaning are effected for time periods with slightly surplus time periods before and after the aforementioned time l, as shown by broken lines.

In the cleaning device of the present invention, the blade 247 is operated for the time period including the slightly surplus time period before and after the above-specified time l, but the aforementioned elastic cleaning roller 249 is actuated for about one second, respectively, when the operation of the aforementioned blade 247 is started and when the cleaning of the whole image surface is completed. This time period can naturally be suitably changed. For the other time period, the aforementioned elastic cleaning roller 249 is held in a position, which is spaced and retracted from the circumference of the photosensitive drum 1, as shown in FIG. 27, by the aforementioned slide of the spring clutch 293 and by turning off the solenoid 300 so that it is kept inoperative during the image formation.

Incidentally, the present embodiment exemplifies the case in which the cleaning device of the present invention is applied to the color image forming apparatus, but can also be used as the cleaning means of the general one-color image forming apparatus with the resultant effects similar to those of the present embodiment.

As has been described hereinbefore, according to the present invention, there is provided an image forming apparatus, in which the steps of forming a latent image by writing an image in the image retainer and of developing the latent image are repeated by a plurality of times, which apparatus is characterized in that its electric state is not abruptly varied during the image formation. As a result, a recorded image of high quality can always be attained stably.

According to the image forming apparatus of the present invention, moreover, it is possible to preclude the insufficient cleaning by the blade and the toner on the circumference of the image retainer from being blotted. There can be attained other effects that the developability and registrating accuracy of a multicolor image are so excellent to provide a high image quality and that the apparatus can be made compact.

Still moreover, the image forming apparatus based on the present invention is freed from any fear of the misregistrations of the individual colors to form a color image of high quality and can be used efficiently in a coupled manner.

According to the present invention, furthermore, even in the image forming apparatus using the blade as the cleaning means, not only the residual toner but also paper powder or foreign matters can be removed without damaging and degrading the photosensitive member. As a result, it is possible to provide an excellent cleaning device which can realize a clear color image of high quality when used with the color image forming apparatus.

What is claimed is:

1. An image forming apparatus in which a step of writing an image on an image retainer and a step of forming a toner image subsequent to said image write-in step are conducted, and a cleaning device is arranged on the outer periphery of said image retainer, said cleaning device bringing into and out of abutment against said image retainer, wherein the improvement resides in that the cleaning device comprises a first cleaning means and a rotary member as a second cleaning means arranged downstream of said first cleaning means in the moving direction of the surface of said image retainer, and a cleaning operation of said rotary member against said image retainer is conducted according to a time at which the cleaning operation of said first cleaning means against said image retainer is conducted.

2. An image forming apparatus in which a step of writing an image on an image retainer and a step of forming a toner image subsequent to said image write-in step are conducted, and a cleaning device is arranged on the outer peripehery of said image retainer, said cleaning device bringing into and out of abutment aginst said image retainer, wherein the improvement resides in that the cleaning device comprises a first cleaning means and a rotary member as a second cleaning means arranged downstream of said first cleaning means in the moving direction of the surface of said image retainer, and the release of said rotary member from abutment against said image retainer is conducted according to the release of said first cleaning means from abutment against said image retainer.

3. An image forming apparatus in which a step of writing an image on an image retainer and a step of forming a toner image subsequent to said image write-in step are conducted, and a cleaning device is arranged on the outer periphery of said image retainer, said cleaning device bringing into and out of abutment against said image retainer, wherein the improvement resides in that the cleaning device comprises a first cleaning means and a rotary member as a second cleaning means arranged downstream of said first cleaning means in the moving direction of the surface of said image retainer, and the abutment of said rotary member against said image retainer is conducted according to the abutment of said first cleaning means against said image retainer.

4. An image forming apparatus according to claim 1, 2, wherein the steps of writing the image on said image retainer and forming the toner image subsequent to said image writing operation are conducted repeatedly to superopse said toner images and then said superposed toner images are transferred.

5. An image forming apparatus in which a step of writing an image on an image retainer and a step of forming a toner image subsequent to said image write-in step are conducted, and a cleaning device is arranged on the outer periphery of said image retainer, said cleaning device bringing into and out of abutment against said image retainer, wherein the improvement resides in that the cleaning device comprises a first cleaning means and a rotary member as a second cleaning means arranged downsream of said first cleaning means in the moving direction of the surface of said image retainer, and the abutment of said rotary member against said image retainer is conducted according to the release of said first cleaning means from abutment against said image retainer.

6. An image forming apparatus in which a step of writing an image on an image retainer and a step of forming a toner image subsequent to said image write-in step are conducted, and a cleaning device is arranged on the outer periphery of said image retainer, said cleaning device bringing into and out of abutment against said image retainer, wherein the improvement resides in that the cleaning device comprises a first cleaning means and a rotary member as a second cleaning means arranged downstream of said first cleaning means in the moving direction of the surface of said image retainer, and the release of said rotary member from abutment against said image retainer is conducted according to the abutment of said first cleaning means against said image retainer.

7. An image forming apparatus according to claim 1, wherein the release of said rotary member from abutment against said image retainer is conducted according to the release of said first cleaning means from abutment against said image retainer.

8. An image forming apparatus according to claim 1, wherein the abutment of said rotary member against said image retainer is conducted according to the abutment of said first cleaning means against said image retainer.

9. An image forming apparatus according to claim 1, wherein the abutment of said rotary member against said image retainer is conducted according to the release of said first cleaning means from abutment against said image retainer.

10. An image forming apparatus according to claim 6, wherein the release of said rotary member from abutment against said image retainer is conducted according to the abutment of said first cleaning means against said image retainer.

11. An image forming apparatus according to claim 5, wherein the steps of writing the image on said image retainer and forming the toner image subsequent to said image writing operation are conducted repeatedly to superpose said toner images and then said superposed toner images are transferred:

12. An image forming apparatus according to claim 1, wherein times at which the abutment and release of said second cleaning means against said iamge retainer are conducted correspond to times at which the abutment and release of said first cleaning means against said image retainer are conducted, respectively.

13. An image forming apparatus according to claim 1, wherein the abutment and release of said second cleaning means against said image retainer are conducted at times at which the abutment and release of said first cleaning means against said image retainer are conducted, respectively, and the cleaning operation by said second cleaning means being continued a predetermined time.

14. An image forming apparatus according to claim 1, wherein times at which the abutment and release of said second cleaning means against said image retainer are conducted interlock to a time at which the abutment or release of said first cleaning means against said image retainer is conducted, said abutment of said second cleaning means against said image retainer being released after a predetermined time.

15. An image forming apparatus according to claim 1, wherein the abutment and release of said second cleaning means against said image retainer are initiated at the same time at which the abutment or release of said first cleaning means against said image retainer is initiated, said abutment of said second cleaning means against said image retainer being released after a predetermined time.

16. An image forming apparatus according to claim 1, wherein said second cleaning means is a resilent roller.

17. An image forming apparatus according to claim 2, wherein the steps of writing the image on said image retainer and forming the toner image subsequent to said image writing operation are conducted repeatedly to superpose said toner images and then said superposed toner images are transferred.

18. An image forming apparatus according to claim 3, wherein the steps of writing the image on said image retainer and forming the toner image subsequent to said image writing operation are conducted repeatedly to superpose said toner images and then said superposed toner images are transferred.

19. An image forming apparatus according to claim 6, wherein the steps of writing the image on said image retainer and forming the toner image subsequent to said image writing operation are conducted repeatedly to superpose said toner images and then said superposed toner images are transferred.

20. An image forming apparatus according to claim 12, wherein said second cleaning means is a resilient roller.

21. An image forming apparatus according to claim 14, wherein said second cleaning means is a resilient roller.

* * * * *